US010043342B2

(12) United States Patent
Yee

(10) Patent No.: US 10,043,342 B2
(45) Date of Patent: Aug. 7, 2018

(54) METHODS AND SYSTEMS FOR WAGERING GAMES

(71) Applicant: BALLY GAMING, INC., Las Vegas, NV (US)

(72) Inventor: Ryan Masao Yee, Las Vegas, NV (US)

(73) Assignee: BALLY GAMING, INC., Las Vegas, NV (US)

( * ) Notice: Subject to any disclaimer, the term of this patent is extended or adjusted under 35 U.S.C. 154(b) by 344 days.

(21) Appl. No.: 14/496,806

(22) Filed: Sep. 25, 2014

(65) Prior Publication Data

US 2016/0093160 A1 Mar. 31, 2016

(51) Int. Cl.

| | |
|---|---|
| ***G07F 17/32*** | (2006.01) |
| ***A63F 1/00*** | (2006.01) |
| ***A63F 3/00*** | (2006.01) |

(52) U.S. Cl.

CPC ..... *G07F 17/3244* (2013.01); *A63F 1/00* (2013.01); *A63F 3/00157* (2013.01); *G07F 17/322* (2013.01); *G07F 17/3276* (2013.01); *G07F 17/3293* (2013.01); *A63F 2001/005* (2013.01); *A63F 2003/00164* (2013.01)

(58) Field of Classification Search

CPC ..... A63F 17/322; A63F 1/00; A63F 3/00157; A63F 2001/005; A63F 17/3244; A63F 17/3293; A63F 17/3272; A63F 17/3276; A63F 2003/00164; G07F 17/3244; G07F 17/3293; G07F 17/322; G07F 17/3276

See application file for complete search history.

(56) References Cited

U.S. PATENT DOCUMENTS

| | | | | |
|---|---|---|---|---|
| 5,685,774 | A | 11/1997 | Webb | |
| 5,863,041 | A * | 1/1999 | Boylan | A63F 3/00157 273/292 |
| 5,931,472 | A | 8/1999 | Ko et al. | |
| 6,007,424 | A | 12/1999 | Evers et al. | |
| 6,267,248 | B1 | 7/2001 | Johnson et al. | |
| 6,588,750 | B1 | 7/2003 | Grauzer et al. | |

(Continued)

OTHER PUBLICATIONS

Commission Free Pai Gow Poker, https://wizardofodds.com/games/commission-free-pai-gow-poker/ (Oct. 2013), 4 pages.*

(Continued)

*Primary Examiner* — Jasson Yoo
(74) *Attorney, Agent, or Firm* — TraskBritt

(57) ABSTRACT

A method of administering a wagering game includes accepting an ante wager to participate in a commission-free pai gow poker game and accepting an optional side wager from at least one player. Randomized physical cards from a set of cards comprising at least one 52-card deck of standard playing cards are dealt to provide a seven-card hand to the at least one player and a seven-card hand to a dealer. The ante wager is resolved by comparing two-card and five-card pai gow player hands formed from the at least one player's seven-card hand with two-card and five-card pai gow dealer hands formed from the dealer's seven-card hand. A payout is paid to the at least one player based on the optional side wager when the dealer's seven-card hand contains a winning hand of a set of predetermined winning hands. Methods also relate to administering wagering games over networks.

18 Claims, 13 Drawing Sheets

(56) References Cited

U.S. PATENT DOCUMENTS

| | | | | |
|---|---|---|---|---|
| 6,659,460 | B2 | 12/2003 | Blaha et al. | |
| 6,698,756 | B1 | 3/2004 | Baker et al. | |
| 6,755,741 | B1 | 6/2004 | Rafaeli | |
| 6,811,153 | B1 | 11/2004 | Ko | |
| 7,195,244 | B1 | 3/2007 | Feola | |
| 7,661,676 | B2 | 2/2010 | Smith et al. | |
| 7,677,565 | B2 | 3/2010 | Grauzer et al. | |
| 7,766,332 | B2 | 8/2010 | Grauzer et al. | |
| 7,841,434 | B2 | 11/2010 | Shimada et al. | |
| 7,901,285 | B2 | 3/2011 | Tran et al. | |
| 7,905,770 | B2 | 3/2011 | Snow | |
| 7,934,980 | B2 | 5/2011 | Blaha et al. | |
| RE42,944 | E | 11/2011 | Blaha et al. | |
| 8,070,574 | B2 | 12/2011 | Grauzer et al. | |
| 8,262,475 | B2 | 9/2012 | Snow et al. | |
| 8,272,958 | B2 | 9/2012 | Smith et al. | |
| 8,342,529 | B2 | 1/2013 | Snow | |
| 8,371,918 | B2 | 2/2013 | Snow | |
| 8,382,569 | B1 | 2/2013 | Falciglia, Sr. | |
| 8,511,684 | B2 | 8/2013 | Grauzer et al. | |
| 8,579,289 | B2 | 11/2013 | Rynda et al. | |
| 2005/0051958 | A1* | 3/2005 | Snow | A63F 1/00 273/274 |
| 2005/0164759 | A1 | 7/2005 | Smith et al. | |
| 2006/0084505 | A1 | 4/2006 | Yoseloff et al. | |
| 2008/0224402 | A1 | 9/2008 | Snow et al. | |
| 2010/0038849 | A1 | 2/2010 | Scheper et al. | |
| 2011/0115160 | A1* | 5/2011 | Snow | G07F 17/32 273/292 |
| 2011/0165928 | A1* | 7/2011 | Snow | G07F 17/32 463/13 |
| 2013/0184059 | A1 | 7/2013 | Costello et al. | |
| 2013/0184079 | A1 | 7/2013 | Costello et al. | |
| 2013/0296025 | A1 | 11/2013 | Castle, II et al. | |
| 2013/0324217 | A1 | 12/2013 | Gilbertson et al. | |
| 2014/0027979 | A1 | 1/2014 | Stasson et al. | |

OTHER PUBLICATIONS

U.S. Appl. No. 14/020,666, filed Sep. 6, 2013, titled "Methods of Administering Pai Gow Poker Games with Bonus Side Bets and Related Apparatuses and Systems," to Hemberger.

U.S. Appl. No. 13/919,849, filed Jun. 17, 2013, and titled "Electronic Gaming Displays, Gaming Tables Including Electronic Gaming Displays and Related Assemblies, Systems and Methods," to Czyzewski et al.

Emperor's Challenge, http://www.wsgc.wa.gov/activities/game-rules/emperors-challenge.pdf (Mar. 2012), 16 pages.

Emperor's Challenge, http://www.galaxygaming.com/galaxy-games/28/emperors-challenge (Downloaded Oct. 2016), 2 pages.

EZ Pai Gow Poker (with Fully Wild Joker), http://wizardofodds.com/games/ez-pai-gow-poker/ (Jun. 2009), 6 pages.

EZ Pai Gow Poker (with Partially Wild Joker), http://wizardofodds.com/games/ez-pai-gow-poker/partially-wild-joker/ (Jan. 2015), 9 pages.

Fortune Pai Gow Poker® No Commission "Rules of Play", SHFL entertainment, Inc.® (Oct. 2009), 2 pages.

Mini Pai Gow, http://wizardofodds.com/games/mini-pai-gow/ (Jun. 2013), 5 pages.

* cited by examiner

METHODS AND SYSTEMS FOR WAGERING GAMES

FIELD

This disclosure relates generally to methods of administering wagering games for casinos and other gaming establishments, and related systems and apparatuses. Embodiments of the disclosure relate to methods of administering pai gow poker games wherein no commission is received by the house on winning player hands, and wherein player's ante wagers push when the dealer holds a predetermined low hand.

BRIEF SUMMARY

In some embodiments, a method of administering a wagering game includes accepting an ante wager to participate in a commission-free pai gow poker game from at least one player by receiving a first physical, monetarily valuable wagering element in a first designated area of a layout on a surface of a gaming table and accepting an optional side bet wager from the at least one player by receiving a second physical, monetarily valuable wagering element in a second designated area of the layout on the surface of the gaming table, the second designated area being separate and distinct from the first designated area. Randomized physical cards from a set of cards comprising at least one 52-card deck of standard playing cards are dealt to provide a seven-card hand to the at least one player and a seven-card hand to a dealer. In some embodiments, the set of cards may include one or more special cards such as joker cards. The ante wager is resolved by comparing two-card and five-card pai gow player hands formed from the at least one player's seven-card hand with two-card and five-card pai gow dealer hands formed from the dealer's seven-card hand. Resolving the ante wager includes taking the player's ante bet when the dealer's five-card player high hand and a two-card low hand respectively outrank the five-card player high hand and the two-card player low hand; awarding a payout based on the ante wager to the at least one player holding a five-card player high hand and a two-card player low hand that respectively outrank the five-card dealer high hand and the two-card dealer low hand; and returning the ante wager to the at least one player when a hand held by the dealer meets certain disqualifying conditions. Disqualifying dealer hands eliminate the need for the dealer to collect a house commission (typically 5%) on any player winnings, which simplifies and speeds play of the game. As a specific, non-limiting example in accordance with one or more embodiments, a "push" occurs when the dealer's low hand is a 9-high. As another specific, non-limiting example, a small, fixed odds payout of between 1:1.5 and 1:4 (e.g., 1:2) may be paid to each player when the dealer's low hand is disqualified. A payout is paid to the at least one player based on the optional side bet wager when the dealer's seven-card hand contains a winning hand of a set of predetermined winning hands. Payouts to the at least one player are made by transferring physical, monetarily valuable wagering elements associated with the payout to the at least one player.

In additional embodiments, a method of administering a wagering game includes accepting an ante wager from each player on a game of pai gow poker to be played against a dealer by receiving a first physical, monetarily valuable wagering element in a first designated area on a surface of a gaming table and accepting a side bet wager from the at least one player by receiving a second physical, monetarily valuable wagering element in a second designated area on the surface of the gaming table, the second designated area being separate and distinct from the first designated area. Randomized physical cards from a set of cards comprising at least one 52-card deck of standard playing cards are dealt to provide a seven-card hand to the at least one player and a seven-card hand to a dealer. In some embodiments, the set of cards may include one or more special cards such as joker cards. The ante wager is resolved as described above.

In yet additional embodiments, a method of administering a wagering game over a network includes receiving, at a processor, an indication that an ante wager to participate in the wagering game is accepted from a player. An indication that a side bet wager is accepted from the player is also received at the processor. Rank and suit information for seven cards allocated to the player is provided from the processor, and rank and suit information from the player to arrange the seven allocated cards into a chosen five-card player high hand and a chosen two-card player low hand is received at the processor. A house way of arranging seven dealer cards allocated to the dealer into a five-card dealer high hand and a two-card dealer low hand is applied at the processor. The ante wager is resolved as described above, with any payout to the player authorized by the processor. The side bet wager is resolved by authorizing, at the processor, a payout to the player based on the side bet wager when the seven cards allocated to the dealer contain a winning hand of a set of predetermined winning hands.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
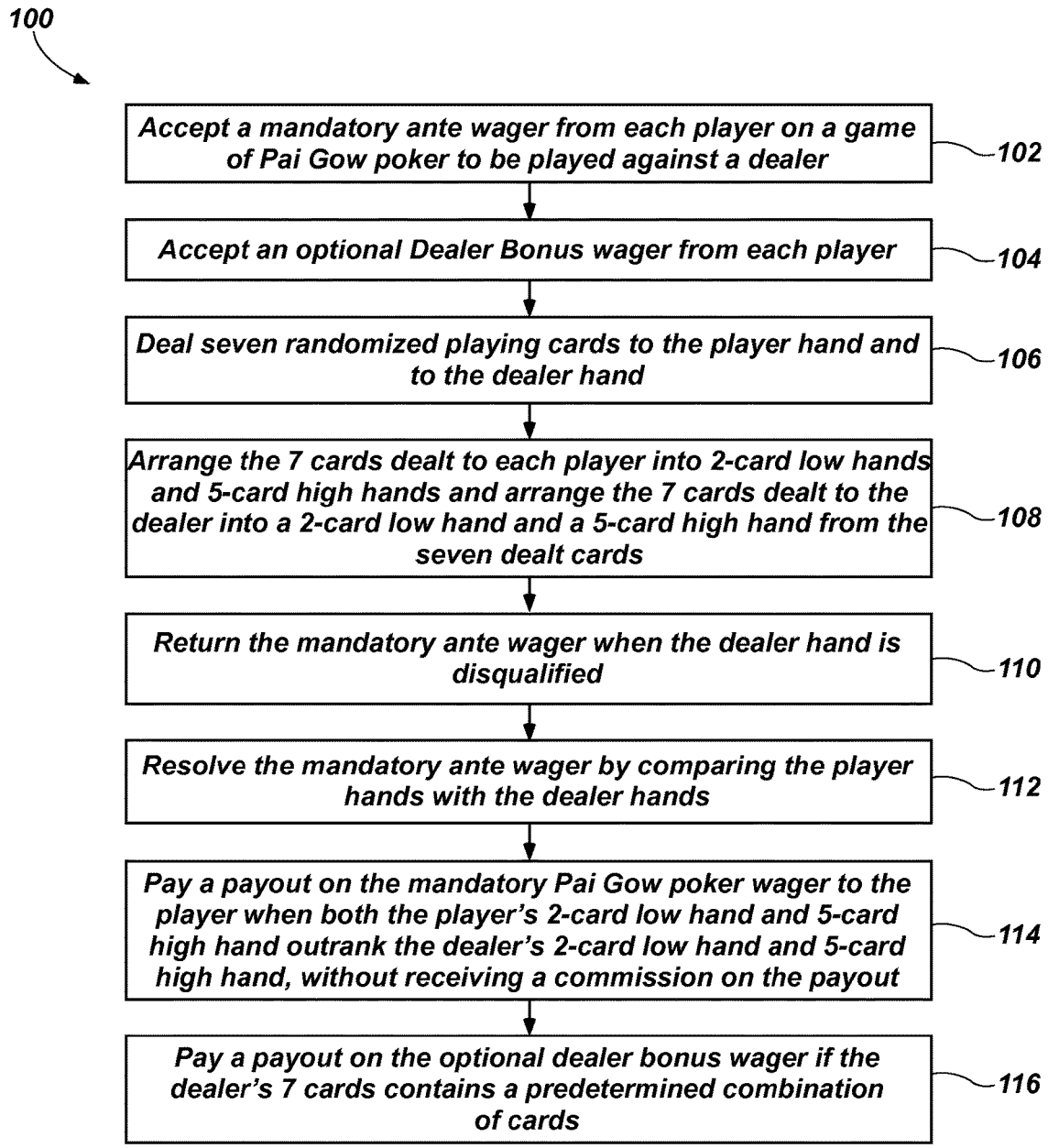
FIG. 1 is a flowchart diagram of a method of administering a wagering game, according to an embodiment of this disclosure.

The illustrations presented in this disclosure are not meant to be actual views of any particular act in a method, apparatus, system, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred generically without an alphabet character suffix.

The terms "gaming," "gambling," or the like, refer to activities, games, sessions, rounds, hands, rolls, operations, and other events related to wagering games the outcome of which is at least partially based on one or more random events ("chance" or "chances"), and on which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay," such as "house-banked," "player-banked," "player-pooled" including "player-pooled progressive," and "dividend refund" configurations, each of which is described in more detail below) or in wagering games that involve no real-world monetary risks for the player (e.g., the "play-for-fun" and "social play-for-fun" configurations described in more detail below).

As used herein, the term "wager" includes any form of wagering value, including money, casino chips, other physical means for payment, and online or remote electronic authorization of a wager in any acceptable form to the casino or online or virtual game host. Also included are physical representations of money (e.g., casino chips) at a local game, as well as virtual representations of money in the form of electronic authorizations of a transfer of money and digital representations of money (e.g., digital representations of bills or coins, digital representations of chips, numerical quantities of money, numerical quantities of points, or numerical quantities of credits) at a local or remote electronic gaming device. As used herein, the term "wagering element" means and includes objects and symbols used to signify the acceptance of a wager. For example, physical wagering elements include physical money (e.g., bills and coins) and physical wagering tokens (e.g., poker chips), which may or may not be redeemable for monetary value and may or may not include electronic identifiers (e.g., RFID chips) embedded within the tokens, enabling electronic sensing and tracking of wagering. Virtual wagering elements include, for example, images (e.g., images of money or poker chips) and text (e.g., a string of numbers), which may or may not be redeemable for monetary value. In the "play-for-fun" and "social play-for-fun" configurations, a "wager" may not have a cash value (i.e., a real-world monetary value).

For the purposes of this description, it will be understood that when an action related to accepting wagers, making payouts, dealing cards, selecting cards, or other actions associated with a player or a dealer is described herein, and such description includes a player or a dealer taking the action, the results of the action may be computer generated and may be displayed on a live or virtual table or electronic display, and, if applicable, the reception or detection of such an action in an electronic form where player and dealer choices, selections, or other actions are received at an electronic interface. This further includes the results of a virtual dealer and virtual players, where the actions described are actually generated by a computer (typically associated with an online game). By way of a further example, if dealing of a card is described herein, the description includes (but is not limited to) the following: the dealing of a card by a dealer from a deck, shuffler, shoe, or other card source and the reception or placement of the card at a table location associated with a player or reception directly by a player; the generation and transmission of an electronic indication or representation of a card from a game play source or server to an electronic receiver, where the receiver may be at a table (using virtual cards) including players and/or virtual players and/or a dealer or virtual dealer, on a gaming terminal, at a public display in a casino, at a remote location (e.g., using online or Internet game play), or at other locations. Also included is the representation of a card on a display or displays, and, if applicable to the action described, an electronic reception of an indication that the card has been received, selected, or otherwise interacted with at a location associated with a player, or, associated with a virtual player. In addition, dealing of a card may refer to revealing a representation of a card on a scratch-off card (also referred to as "scratchers").

Figure 6:
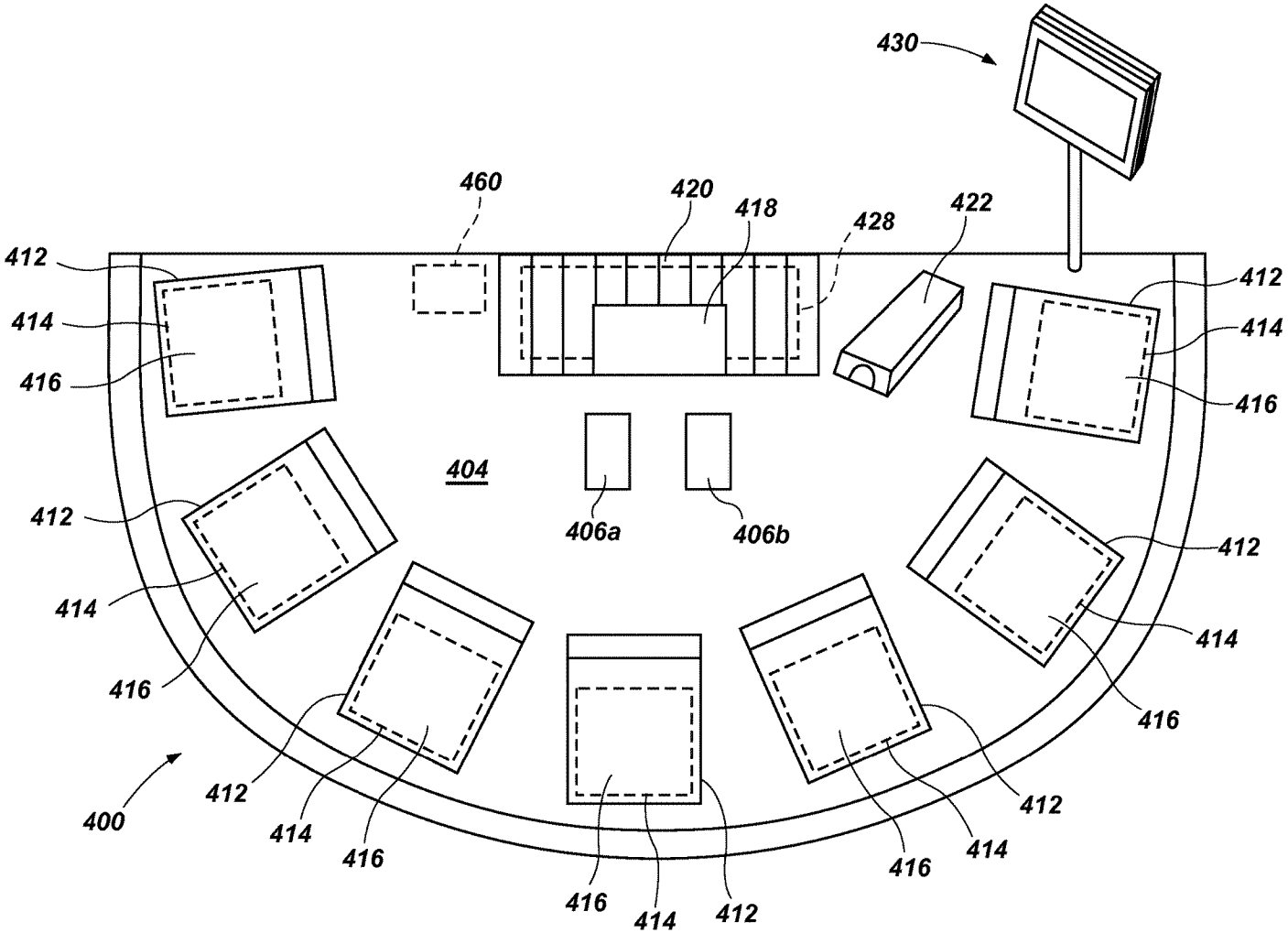
FIG. 6 is a top view of a table configured for implementation of embodiments of wagering games in accordance with this disclosure.
Figure 7:
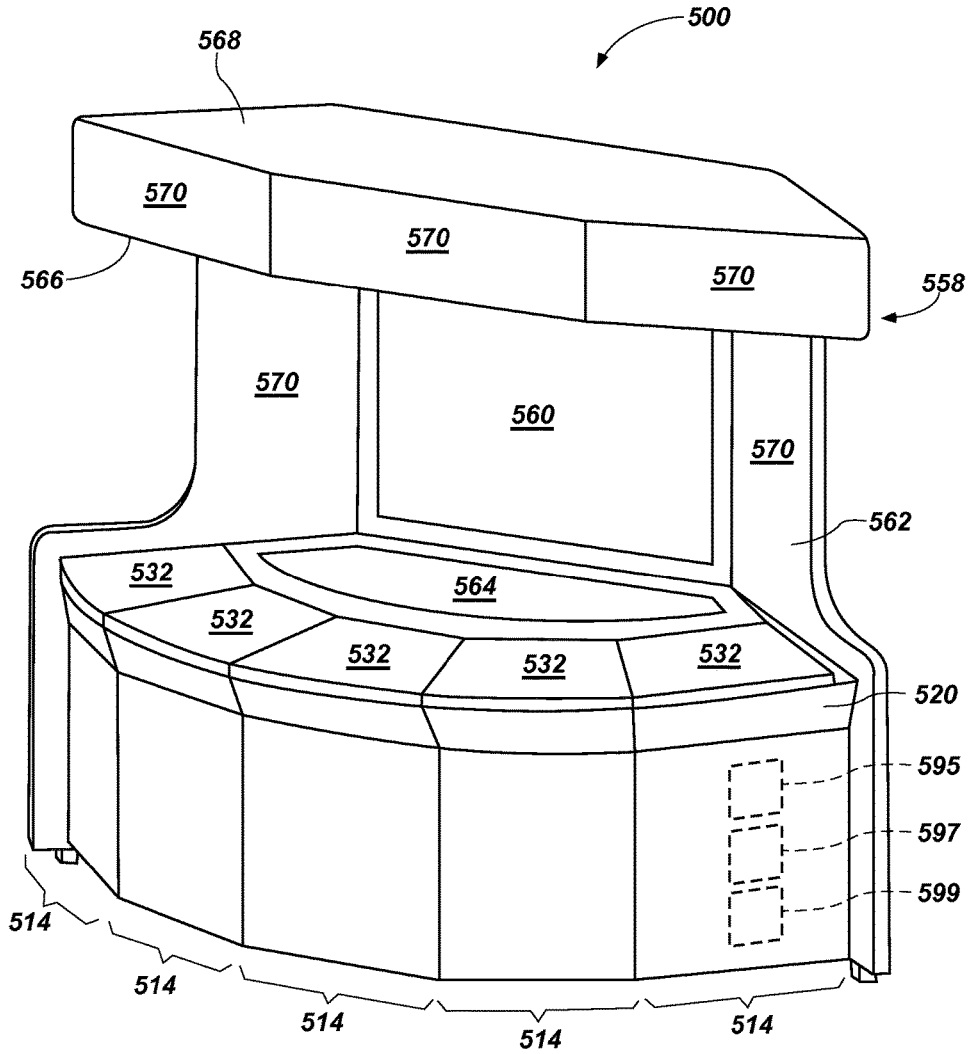
FIG. 7 is a perspective view of another embodiment of a table configured for implementation of embodiments of wagering games in accordance with this disclosure, wherein the implementation includes a virtual dealer.

Referring to FIG. 1, a flowchart diagram of a method 100 of administering a wagering game is shown. The method 100 may include accepting a wager (e.g., an ante wager) from each player for a game of pai gow poker to be played against a dealer, as indicated at operation 102. For example, the ante wager may comprise a bet that both a five-card high hand and a two-card low hand held by a player will outrank the five-card high hand and the two-card low hand respectively held by the dealer in accordance with the rules of pai gow poker or the rules of a known pai gow poker variant. The ante wager may be accepted, for example, by a dealer physically receiving money, by receiving a representation of money such as a player input signal indicating a wager has been placed, (e.g., a chip or token), or by receiving electronic authorization to charge a player account (e.g., a credit account or a bank account). The ante wager may be accepted, for example, by physically receiving chips within a designated area 128 (FIGS. 2, 3) on a playing surface 118 (FIG. 2) of a gaming table 200, 400, or 500 (FIGS. 4, 6, 7), by automatically detecting (e.g., using sensors, such as, for example, optical or RFID sensors) the presence of chips within the designated area 128 (FIGS. 2, 3) on the playing surface 118 of the playing table 200, 400, or 500 (FIGS. 4, 6, 7), or by receiving electronic authorization at a processor 350, 414, 428, 597, or 642 (FIGS. 5 through 7, 10) to charge a player account via a player interface 332, 416, 532, 624, or 644 (FIGS. 5 through 8, 10) or dealer interface 418 (FIG. 6), where the player interface 332, 416, 532, 624, or 644 may be remotely located from the dealer or a server of which the processor 350, 414, 428, 597, or 642 (FIGS. 5 through 7, 10) is a component. As a specific, non-limiting example, the ante wager, which may be mandatory for participation in the wagering game, may be accepted by receiving a physical, monetarily valuable wagering element 212 (FIG. 4) in the first designated area 128 (FIGS. 2, 3) on the surface 118 (FIG. 2) of the gaming table 200, 400, or 500 (FIGS. 4, 6, 7).

One or more side wagers may be accepted from the at least one player. For example, one or more side wagers may comprise a bet related to the occurrence of an event independent of the ultimate outcome of the pai gow poker game. The one or more side wagers may be accepted by performing any of the acts described above in connection with the ante wager, though the designated areas for receiving such side wagers may or may not differ. For example, designated areas 130, 132, 134, 136, 138 (FIGS. 2, 3) may be employed in the reception of side wagers, as described further below.

For example, a fortune side wager may be accepted from at least one player. The fortune side wager may include, for example, a bet that a high hand, a seven-card hand, or a best five out of seven cards dealt to the player will be of a predetermined rank or higher. If such a winning hand is achieved by the player, an odds payout may be paid to the player. In some embodiments, a qualifying fortune side wager may also result in a fixed envy payout, in addition to the odds payout, when a best five-card hand held by a different player than the one placing the fortune side wager will be of a predetermined envy rank or higher. For example, the fortune side wager may qualify for the fixed envy payout if the high hand or best five cards out of a seven-card hand of a different player will be of the predetermined envy rank or higher when an amount of the fortune side wager is greater than or equal to a threshold amount. As a specific, non-limiting example, the threshold amount of the fortune side wager may be five dollars or more. If the fortune side wager is received in an amount less than the threshold amount, the fortune side wager may function only as a wager that the high hand or the best five out of seven-card hand achieved by the player from whom the fortune side wager is received will be of the predetermined fortune rank or higher. The fortune side wager may be accepted by performing any of the acts described above in connection with accepting the ante wager.

In one embodiment, the fortune side wager pays according to the following payout schedule (including example fixed envy bonus payouts for qualifying fortune side wagers) as shown in TABLE 1:

TABLE 1

| Player Hand | Payout Odds | Envy Bonus |
|---|---|---|
| Seven-Card Straight Flush | 8000:1 | $5,000.00 |
| Royal Flush + Royal Match* | 2000:1 | $1,000.00 |
| Seven-Card Straight Flush with Joker | 1000:1 | $500.00 |
| Five Aces | 400:1 | $250.00 |
| Royal Flush (5 cards) | 150:1 | $50.00 |
| Straight Flush (5 cards) | 50:1 | $20.00 |
| Four-of-a-Kind | 25:1 | $5.00 |
| Full House (5 cards) | 5:1 | |
| Flush (5 cards) | 4:1 | |
| Three-of-a-Kind | 3:1 | |
| Straight (5 cards) | 2:1 | |

*King-Queen suited

In one embodiment, an envy bonus may be paid to a player from whom a threshold fortune side wager is received when another, different player holds a qualifying hand of four-of-a-kind or better. Players may not be eligible to win an envy bonus on the players' respective own hands. Players also may not be eligible to win an envy bonus when the dealer holds a hand of a minimum qualifying rank. If two players qualify for an envy bonus, both of the players may win an envy bonus payout. In one example, such as in the example shown in TABLE 1 above, envy bonus payouts are fixed amounts. In other embodiments, envy bonuses are odds payout amounts. If a player meets a minimum threshold amount, such as $5.00, when making the fortune side wager, the dealer marks the player bet with a lammer or token. When a winning envy hand is achieved by one player, an envy bonus payout may be paid to other players marked with lammers or tokens according to the posted paytable.

In additional embodiments, a progressive side wager may be accepted from at least one player. The progressive side wager may comprise, for example, a bet that a high hand held by the player making the progressive side wager will be of a predetermined rank or higher. Alternatively or additionally, the progressive side wager may comprise a bet that a seven-card hand held by a player including the cards of the five-card high player hand and two-card low player hand contains a winning hand of a set of predetermined winning progressive hands. Alternatively or additionally, the progressive side wager may be a bet that the cards held by the player making the progressive side wager will form a premium hand, such as, for example, a five-card hand not achievable using a standard, 52-card deck, or a premium seven-card hand.

Any progressive side wagers accepted may be pooled in a progressive pot, which may be linked to a group of players playing the wagering game. For example, all progressive side wagers received from players at the same table 400 (FIG. 6), from players at a grouping of tables 400 (FIG. 6), from players at a grouping of electronic gaming machines 300 (FIG. 5), from players connected to a game service 616 (FIG. 8), from players physically located at a gaming establishment, from players remotely connected to a gaming establishment, from all players participating in the wagering game offered by a gaming establishment, or from all players participating in the wagering game at multiple gaming establishments may be pooled into a progressive pot. The progressive side wager may be accepted by performing any of the acts described above in connection with the ante wager.

A progressive wager payout may be paid to a player from whom a progressive wager is received when that player is dealt a winning hand of a set of winning hands. The cards forming the winning hand may be chosen from the player's seven-card hand. Alternatively, in some embodiments, the cards forming the hand of predetermined rank or higher may be chosen from only the player's five-card high pai gow hand, or other combinations of cards from the player's two-card low pai gow hand and five-card high pai gow hand. The progressive side wager may pay a percentage of the progressive pot to a player holding a winning hand. In some embodiments, occurrence of one or more of the predetermined winning hands may pay a percentage payout of the progressive pot, while occurrence of one or more other predetermined winning hands may pay from the progressive pot according to a fixed-odds payout.

For example, in one embodiment, the progressive side wager pays according to the following payout schedule shown in TABLE 2:

TABLE 2

| Player Hand | Pays |
|---|---|
| Seven-Card Straight Flush | 100% of progressive pot |
| Five Aces | 10% of progressive pot |
| Royal Flush | 500 to 1 |
| Straight Flush | 100 to 1 |
| Four-of-a-Kind | 75 to 1 |
| Full House | 4 to 1 |

The progressive pot may initially be seeded with a base amount. Portions of progressive wagers made by players and lost during gameplay may be added to the seed amount in the progressive pot, such that the amount in the progressive pot increases as players make and lose progressive wagers. After a payout of the entire progressive pot, for example, upon the occurrence of a seven-card straight flush in a wagering player's hand, the progressive pot may be reseeded with the base amount. The base "seed" amount may be, in one embodiment, $10,000.

Additionally, in some embodiments, a bad beat side wager may be accepted from at least one player. The bad beat side wager may comprise, for example, any of the bad beat side wagers disclosed in U.S. Patent Application Pub. No. 2008/0224402, published Sep. 18, 2008, for "BAD BEAT SIDE BET ON HOUSE-BANKED CASINO CARD GAMES," the disclosure of which is incorporated herein in its entirety by this reference. For example, the bad beat side wager may comprise a bet that a high hand held by the player, a low hand held by the player, or both the high hand and the low hand held by the player will be of a predetermined bad beat rank or higher. The bad beat side wager may be accepted by performing any of the acts described previously in connection with the ante wager.

Additionally, a dealer bonus side wager may be accepted from the at least one player, as indicated at operation 104 of FIG. 1. The dealer bonus side wager may comprise a bet related to the occurrence of an event independent of the ultimate outcome of the pai gow poker game. For example, the dealer bonus side wager may comprise a bet that a dealer hand formed of one or more cards from one or both of the dealer's two-card low hand and five-card high hand contains a winning hand of a set of predetermined winning hands. In one embodiment, the dealer bonus side wager may be an optional side wager to be placed at will by the player. In other embodiments, the dealer bonus side wager may be a mandatory bet required to be placed to enable the player to participate in the underlying pai gow poker game.

The winning hands of the set of predetermined winning hands may include cards chosen from at least one of the dealer's two-card low hand, the dealer's five-card high hand, and a seven-card dealer hand comprising the cards of both the dealer's two-card low hand and the dealer's five-card high hand. In some embodiments, the side wager may comprise a bet by a player that the dealer's seven-card hand contains a combination of cards that forms a winning hand of the set of predetermined winning hands. The winning dealer hand may comprise, as non-limiting examples, a particular card, a two-card hand, a three-card hand, a four-card hand, a five-card hand, a six-card hand, or a seven-card hand. Such winning hands may be traditional poker hands or similar hands, e.g., a straight, a flush, three- or four-of a kind, a full house, etc. In other embodiments, the winning hands may be unrelated to traditional poker hands, may comprise combinations of traditional and/or other hands, or may comprise other combinations of cards.

As non-limiting examples, the set of predetermined winning hands may include one or more of a seven-card flush, a seven-card straight, and a seven-card straight flush. As another non-limiting example, the set of predetermined winning hands may include a combination of one two-card poker hand and one five-card poker hand. For example, one predetermined winning hand may include a two-card hand with a king and queen of matching suit ("Royal Match") and a five-card hand with a royal flush (i.e., an ace-high straight flush). In other embodiments, the set of predetermined winning hands may include winning hands having seven or fewer constituent cards.

In one specific, non-limiting example, a winning dealer bonus side wager may result in a fixed-odds payout made to the player if the dealer's seven-card hand contains a particular predetermined winning hand as described above. In additional embodiments, the payout may include percentage payouts from, e.g., a progressive jackpot. Payouts from such a jackpot may be made in addition to or instead of fixed-odds payouts. In some embodiments, a fixed-odds payout may be made for at least one particular predetermined winning hand, and a progressive jackpot payout may be made for at least one other particular winning hand. The payout odds of a fixed-odds payout or the percentage payout from a progressive jackpot may be chosen based on the probability that a dealer hand of seven cards dealt from randomized cards of one or more decks of 52 standard playing cards will contain the particular predetermined winning hand associated with the payout. For example, a predetermined winning hand less likely to occur may be associated with a higher payout, and, conversely, a predetermined winning hand more likely to occur may be associated with a lower payout. The dealer bonus side wager may be accepted by performing acts similar to those described above in connection with the ante wager, e.g., receiving money or chips within a side wager position 130 (FIGS. 2 and 3) of the playing surface 118 (FIG. 2) of the gaming table 200 (FIG. 4) or by receiving electronic authorization at a processor 350, 414, 428, 597, or 642 (FIGS. 5 through 7 and 10).

In one non-limiting example embodiment, the dealer bonus side wager pays according to the following payout schedule as shown in TABLE 3:

TABLE 3

| Dealer Hand | Payout Odds |
|---|---|
| Seven-Card Straight Flush | 500:1 |
| Royal Flush + Royal Match | 500:1 |
| Five Aces | 500:1 |
| Royal Flush | 150:1 |
| Straight Flush | 50:1 |
| Four-of-a-Kind | 25:1 |
| Full House | 4:1 |
| Flush | 3:1 |
| Three-of-a-Kind | 2:1 |
| Straight | 2:1 |
| Nine high low hand | 5:1 |

TABLE 3 is provided as a non-limiting example of a payout schedule for the dealer bonus side wager. In other embodiments, a payout schedule for the dealer bonus may include additional winning hands (e.g., a particular card or particular combinations of two or more cards not included in TABLE 3). Other embodiments of payout schedules may also include different fixed payout odds, or a payout schedule based on a percentage of a progressive jackpot for all or for some winning dealer hands.

In some embodiments, the dealer side bonus wager may be paid only for the highest payout. For example, with reference to TABLE 3 above, if a five-card poker hand formed from five of the seven cards in the dealer's seven-card hand is a three-of-a-kind or a straight, and the remaining two cards form a nine-high low hand, the player may be paid only for the nine-high low hand, since the nine-high low hand pays more than either the three-of-a-kind or the straight. In other embodiments, a player may be paid for every predetermined winning hand appearing in the dealer's seven-card hand.

Finally, a dealer rank side wager may be accepted from the at least one player. The dealer rank side wager may comprise a bet that the low hand held by the dealer will be of a particular disqualifying rank. The dealer rank side wager may be accepted by performing any of the acts described above in connection with the ante wager, though the designated wager position may or may not differ, as described above. In some embodiments, a player may be given an option to make a dealer bonus side wager or to make the dealer rank side wager, but not both. In other words, a player may be allowed to make a wager on one of, and only one of, the dealer bonus side wager and the dealer rank side wager.

Once all wagers (e.g., ante wagers and, optionally, side wagers, such as the fortune side wager, the dealer bonus side wager, and the progressive side wager) have been accepted from all participating players, seven cards may be dealt to each player and the dealer, as indicated at operation 106, which cards may be used to form a five-card high hand and a two-card low hand for each player and dealer, as indicated at operation 108. Dealing the cards to each player and to the dealer may comprise, for example, placing physical playing cards in respective participating player positions and a dealer position. The physical playing cards may be provided from an automatic card shuffler. In some embodiments, packets of seven randomized cards may be provided by an automatic card shuffler and respectively dealt to each player and the dealer. Alternatively or additionally, dealing the cards may include electronically displaying rank and suit information (e.g., images, text, or both) of playing cards electronically assigned to each participating player position and a dealer position. Players may physically position five cards in a high hand area 124 (FIGS. 2 and 3) to form the high hand and may physically position the remaining two cards in a low hand area 126 (FIGS. 2 and 3) to form the low hand. In other embodiments, players may interact with the player interface 332, 416, 532, or 620 (FIGS. 5 through 8) to electronically indicate which cards are to be included in the high hand and which cards are to be included in the low hand. The player's selections may be received and accepted by, for example, visually inspecting the arrangement of physical cards (e.g., using RFID sensors to detect RFID tags associated with cards or using an image capture device and image processing software to analyze the cards and their arrangement), or automatically processing the electronic indications made by players using a processor 350, 414, 428, 597, or 642 (FIGS. 5 through 7 and 10). If a player's low hand outranks the player's high hand, the player may be required to revise the selected high and low hands such that the high hand outranks the low hand, in accordance with the rules of conventional pai gow poker. Revising the high and low hands, and accompanying receipt and acceptance, may be accomplished by performing any of the acts described previously in connection with the original selection, receipt, and acceptance of the high and low hands.

The dealer or processor may also select which of the seven dealer cards will form a five-card high hand and which cards will form a two-card low hand. In embodiments including the participation of a live dealer, the method used by the dealer to form the high and low hands may be dictated by a set of rules for setting the high and low hands for the dealer, the set of rules commonly referred to as the "house way." The house way of selecting the dealer's high and low hands may comprise, for example, any of the house ways disclosed in U.S. Pat. No. 8,342,529, filed Oct. 1, 2009 and issued Jan. 1, 2013, for "AUTOMATED HOUSE WAY INDICATOR AND ACTIVATOR," the disclosure of which is incorporated herein in its entirety by this reference. For example, the dealer's cards may be arranged to both ensure that the dealer's high hand outranks the dealer's low hand and increase the likelihood that at least one of the dealer's high and low hands will outrank the corresponding high hand or low hand of each player. In other embodiments, the dealer may select at will how to arrange cards into the high hand and the low hand, although it may still be required that the high hand outrank the low hand. The dealer may select the high hand and the low hand, for example, by performing any of the actions described previously in connection with the selection of the player's high and low hands or the dealer's high and low hands may be automatically generated by a processor 350, 414, 428, 597, or 642 (FIGS. 5 through 7 and 10), which may be programmed to apply the house way of forming the high and low hands.

In some embodiments, a player may request that the dealer assist in setting the player's high and low hands. The dealer may utilize the automated house way indicator and activator, described above, to assist in setting the player's high and low hands. In one embodiment, the dealer may be required to set the player hand according to the house way if the player requests assistance.

As indicated in FIG. 1 at operation 110, after the high hands and the low hands of each player and the dealer are formed as discussed above, the dealer's low hand may be examined first to determine whether the dealer's hands are eligible to continue with the underlying game of pai gow poker. According to this modification of conventional pai gow rules, if the dealer's low hand is of a particular predetermined rank, the dealer's hands may be disqualified. Disqualification may result, for example, in a push, causing at least each ante wager to be returned to each player, or a dealer loss, resulting in a payout to each player. As another specific, non-limiting example, a small, fixed odds payout of between 1:1.5 and 1:4 (e.g., 1:2) may be paid to each player when the dealer's low hand is of the predetermined rank. The predetermined, disqualifying rank may be, for example, a nine high. Disqualifying the dealer's hands based on the rank of the low hand may enable the game of pai gow poker to remain profitable for the casino or other gaming establishment even when commissions on player's winnings are not collected by the house. By refraining from collecting commissions, and avoiding the necessity to calculate and collect the commission, the speed with which each round of play is administered is increased, which increases the profitability of pai gow poker by enabling more wagers to be made per unit of time. In embodiments where a player is permitted to act as a banker, the house may retain a portion of the banking player's net earnings (e.g., 5% of the banking player's net earnings). Such an embodiment may still be characterized as "commission free" as no commission is received from any winning player not acting as banker. The lack of commission on player winnings may incentivize players to play. Basing the decision on whether the dealer's hands are eligible on the low hand may reduce player disappointment when the dealer's hands are disqualified. For example, the dealer's hands may be disqualified even when the dealer's high hand ranks very high (e.g., is a royal flush, a straight flush, or a four-or-a-kind), which may be a relief to players who otherwise would have lost. A disqualification decision based on the high hand, by contrast, may disappoint players holding particularly strong hands because they may otherwise have won outright.

In embodiments where disqualification of the dealer's hands results in a push, each ante wager may be returned to the respective players. Returning the ante wagers to the players may comprise, for example, physically returning money or chips to a player or issuing electronic authorization to credit a player account. More specifically, the ante wager may be returned, for example, by physically removing chips from the ante wager position 128 (FIGS. 2 and 3) on the playing surface 118 (FIG. 2) of the playing table 400 (FIG. 6), by receiving electronic authorization at the processor 350, 414, 428, 597, or 642 (FIGS. 5 through 7 and 10) to credit a player account via a dealer interface 418 (FIG. 6), or by automatically generating electronic authorization at the processor 350, 414, 428, 597, or 642 (FIGS. 5 through 7 and 10).

In embodiments where disqualification of the dealer's hands results in a payout, a payout may be paid to each player. Paying the payout may comprise, for example, physically giving money or chips or by granting electronic authorization to transfer funds to a player account. More specifically, the payout may be paid, for example, by physically placing chips within a player position 120 on a playing surface 118 (FIG. 2) of the playing table 400 (FIG. 6), by receiving electronic authorization at a processor 350, 414, 428, 597, or 642 (see FIGS. 5 through 7 and 10) via a dealer interface 418 (see FIG. 6) to transfer funds from an account server 610 (see FIG. 8) to a player account, or automatically generating electronic authorization at the processor 350, 414, 428, 597, or 642 (see FIGS. 6 through 8 and 10) to transfer funds from an account server 610 to a player account (see FIG. 8).

Determining whether the dealer hand qualifies to continue with the game of pai gow poker may also resolve the dealer rank side wager. For example, when the dealer's low hand is not of the predetermined rank, the dealer rank side wager may lose, resulting in the dealer collecting the amount of the dealer rank side wager. For example, the dealer rank side wager in one embodiment pays 30:1 when the dealer's low hand is a nine high. If the dealer holds any other hand, the wager is lost and the house takes the wager. Returning the amount of the dealer rank side wager may be accomplished by performing any of the acts described previously in connection with the push on the ante wager resulting from the dealer's disqualifying low hand. Collecting the amount of the dealer rank side wager may be accomplished, for example, by physically retrieving money or chips or granting electronic authorization to transfer funds to a dealer account. More specifically, collecting the amount of the dealer rank side wager may be accomplished, for example, by physically retrieving chips from a dealer rank side wager position 138 on the playing surface 118 (FIG. 2) of a playing table 400 (FIG. 6), receiving electronic authorization at a processor 350, 414, 428, 597, or 642 (FIGS. 5 through 7 and 10) via a dealer interface 418 (FIG. 6) to transfer funds from a player account to an account server 632 (FIG. 8), or automatically generating electronic authorization at the processor 350, 414, 428, 597, or 642 (FIGS. 5 through 7 and 10) to transfer funds from an account server 610 to a player account (see FIG. 8).

When the dealer's low hand is of the predetermined, disqualifying rank, a bonus payout may be paid on the dealer rank side wager. For example, a fixed odds bonus payout of between 25:1 and 35:1 (e.g., 30:1) may be paid on the dealer rank side wager when the dealer's low hand is disqualified. In one embodiment, dealer rank side wager is referred to as a "TIGER 9™" side bet. Thus, the dealer rank side wager may enable a player to receive a bonus payout when the player may not otherwise receive a payout because of the dealer's hands' disqualification (e.g., where the dealer's disqualifying low hand results in a push or a loss on the ante wager). Paying the bonus payout on the dealer rank side wager may be accomplished by performing any of the acts described above in connection with paying the payout on the ante wager as a result of the dealer's disqualified low hand.

If the dealer's low and high hands qualify to continue with the game of pai gow poker, the ante wager may be resolved by comparing each player's high hand and low hand with the dealer's high hand and low hand as indicated in FIG. 1 at operation 112. If the player's high hand outranks the dealer's high hand, and the player's low hand outranks the dealer's low hand, a payout may be paid to the player, as indicated at operation 114 (FIG. 1). According to one or more embodiments, no commission is received or retained on the payout, since the house edge is accomplished through the disqualification of certain dealer hands, as described above. In some embodiments, wild cards may be used to form a more desirable hand than would otherwise be achieved based on the dealt cards alone. For example, the game may be played with a 53-card deck including a joker, which may be semi-wild, meaning the joker may be used as an ace or to complete a straight, flush, or straight flush. In other embodiments, the joker may be fully wild, i.e., the joker can substitute for any rank and suit. Paying the payout on the ante wager may be accomplished by performing any of the acts described above in connection with the payout resulting from a dealer's disqualifying low hand. The payout on the ante wager may be, for example, a fixed odds payout. As a specific, non-limiting example, the payout on the ante wager for the underlying pai gow poker game may be, for example, between 1:1 and 2:1. In one example, the payout is 1:1 on the ante wager. In some embodiments, the basis for the payout on the ante wager may be the amount of the ante wager itself. In other embodiments, the basis for the payout may further include the amount of one or more of the dealer bonus side wager, the dealer rank side wager, and the fortune side wager. If one of the dealer's high hand and low hand outranks the corresponding high hand or low hand of the player, and the other of the dealer's high hand and low hand is outranked by the corresponding high hand or low hand of the player, the ante wager may be a push, causing the ante wager to be returned to the player. Returning the ante wager to the player may be accomplished by performing any of the acts described above in connection with the push resulting from a dealer's disqualifying low hand. If the dealer's high hand outranks the player's high hand, and the dealer's low hand outranks the player's low hand, the amount of the ante wager may be collected by the dealer. Collecting the amount of the ante wager may be accomplished by performing any of the acts described previously in connection with collecting the dealer rank side wager.

Resolution of the dealer bonus side wager may occur before, simultaneously with, or after resolution of the ante wagers and other side wagers. As indicated at operation 116 of FIG. 1, resolution of the dealer bonus side wager may include paying a payout to at least one player based on the presence of a predetermined combination of cards in the dealer's seven-card hand. The payout on the dealer bonus side wager may be independent of the cards contained in the player's seven-card hand. In other words, the player may receive a payout on the dealer bonus side wager based solely on the cards in the dealer's hand, with a comparison of the player's hand to the dealer's hand having no bearing on the dealer bonus payout. Thus, the dealer bonus side wager may provide an additional incentive for players to participate in the underlying game of pai gow poker, as the dealer bonus may provide an additional or alternative payout under conditions unrelated to the strength of the player's hand. For example, even if the player has a weak hand compared to the dealer's hand and loses the ante wager, the dealer's hand may be of sufficient rank to qualify the player for a payout from a bet made on the dealer bonus side wager. This may mitigate feelings of player disappointment associated with holding a losing hand, and add an additional dimension of excitement to the gameplay.

In embodiments where the fortune side wager has been received in an amount less than the threshold amount, the fortune side wager may be resolved, for example, by evaluating the best five-card hand made from the seven cards dealt to the player to determine whether the best five-card hand is of the predetermined minimum fortune rank or higher. The predetermined minimum fortune rank may comprise, for example, two pair, three pair, three-of-a-kind, or a five-card straight. In one example, the minimum hand ranking for a winning fortune hand is a five-card straight. In another example, the minimum hand ranking is three-of-a-kind. In some embodiments, the fortune side wager may remain in play regardless of whether the dealer's low hand is of the disqualifying rank. In other embodiments, the fortune side wager may receive the same consequences as the ante wager (i.e., may entitle the player to a small payout or may be a push) when the dealer's low hand is of the disqualifying rank. The fortune payout for the fortune side wager may be different from the payout for the ante wager. For example, the fortune payout on the fortune side wager may be a fixed odds payout that increases for the player's achievement of increasingly unlikely hands. An illustrative paytable for the fortune payout on the fortune side wager is shown above in TABLE 1. Paying the fortune payout may be accomplished by performing any of the acts described above in connection with the payout resulting from a dealer's disqualifying low hand. When the five-card hand or seven-card hand achieved by the player is less than the predetermined fortune rank, the fortune side bet may be a push or may be collected by the dealer. Returning the fortune side bet to the player may be accomplished by performing any of the acts described above in connection with the push resulting from a dealer's disqualifying low hand, and collecting the fortune side bet may be accomplished by performing any of the acts described above in connection with collecting the dealer rank side wager.

In embodiments where the fortune side wager has been received in an amount exceeding the threshold amount, resolving the fortune side wager may further include evaluating the best five out of seven-card hands of the players other than the player from whom the fortune side wager was received. If at least one of the best five out of seven-card hands held by the other players is of a predetermined envy rank or higher, an envy payout may be paid to the other players. The predetermined envy rank may be, for example, a full house, four-of-a-kind, a straight flush, a royal flush, five-of-a-kind, five aces, a seven-card flush, a seven-card flush including a joker, or a royal flush. In some embodiments, a separate envy payout may be paid for each other player when one player has achieved a best five out of seven-card hand of the predetermined envy rank or higher. In other embodiments, only a single envy payout may be paid. The envy payout may be, for example, a fixed payout that increases in value when the other player achieves an increasingly unlikely hand. TABLE 1 above shows an illustrative pay table for the envy payout. Paying the envy payout may be accomplished by performing any of the acts described above in connection with, for example, the payout resulting from a dealer's disqualifying low hand.

The progressive side wager may be resolved by evaluating the best five out of seven-card hand achieved by the player to determine whether the hand is of the predetermined progressive rank or higher. The predetermined progressive rank may be, for example, a straight, a flush, a four-of-a-kind, or a straight flush. If the hand achieved by the player is of the predetermined progressive rank or higher, a progressive payout may be given to the player. The progressive payout for achieving a hand of the predetermined progressive rank may be, for example, a fixed odds payout or a percentage of the progressive pot. In other embodiments, the payout may be a fixed amount. Resolving the progressive side wager may also comprise evaluating the best five out of seven-card hand achieved by the player to determine whether the hand is a premium hand. A greater progressive payout may be paid for achieving a premium hand than merely for achieving the predetermined progressive rank. For example, achieving a hand of the predetermined progressive rank may result in a fixed odds payout being paid to the player, and achieving a premium hand may result in a percentage of the progressive pot being paid to the player. An illustrative paytable for the progressive payout is shown above in TABLE 2.

Paying the progressive payout may be accomplished by performing any of the acts described above in connection with the payout resulting from a dealer's disqualifying low hand. A rake may be taken on the progressive payout in some embodiments.

The bad beat side wager may be resolved by examining each player's high hand and low hand and, in some embodiments, comparing them to the high hand and low hand of the dealer. When the player's high hand, low hand, or both high hand and low hand are of a predetermined bad beat rank or higher, the player may be awarded a bad beat payout. In some embodiments, the player may only be eligible for the bad beat payout if the player achieves the predetermined bad beat rank or higher and still loses to the dealer according to the rules for the ante wager. In other embodiments, the player may only be eligible for the bad beat payout if the player achieves the predetermined bad beat rank or higher and wins against the dealer according to the rules of the ante wager. In some embodiments, whether a player win or a player loss renders the player eligible for the bad beat payout may depend on the particular predetermined bad beat rank achieved by the player or on the difference in rank between the dealer's hands and the player's hands. An illustrative paytable for the bad beat payout is shown in TABLE 4:

TABLE 4

| Losing Hand Achieved | Bad Beat Payout |
|---|---|
| Straight Flush | 10,000:1 |
| Four-of-a-Kind | 500:1 |
| Full House | 40:1 |
| Flush | 25:1 |
| Straight | 20:1 |
| Three-of-a-Kind | 9:1 |

Paying the bad beat payout may be accomplished by performing any of the acts described above in connection with the payout resulting from a dealer's disqualifying low hand.

Various platforms are contemplated that are suitable for implementation of embodiments of wagering games according to this disclosure. For example, embodiments of wagering games may be implemented as live table games with an in-person dealer, electronic gaming machines, partially or fully automated table games, and partially or fully automated, network-administered games (e.g., Internet games) wherein game results may be produced utilizing a processor or a live video feed of a dealer administering a game from a remote studio.

As previously noted, any of the present methods and games may be played as a live casino table card game, as a hybrid casino table card game (with virtual cards or virtual chips), on a multi-player electronic platform (as disclosed in U.S. patent application Ser. No. 10/764,827, filed Jan. 26, 2004, published as U.S. Patent Application Publication No. 2005/0164759 on Jul. 28, 2005, now abandoned; U.S. patent application Ser. No. 10/764,994, filed Jan. 26, 2004, now U.S. Pat. No. 7,661,676, issued Feb. 16, 2010; and U.S. patent application Ser. No. 10/764,995, filed Jan. 26, 2004, now U.S. Pat. No. 8,272,958, issued Sep. 25, 2012; the disclosure of each of which applications and patents is incorporated herein in its entirety by this reference), on a personal computer for practice, on a hand-held game for practice, on a legally-authorized site on the Internet, or on a play-for-fun site on the Internet.

For example, in one embodiment, the players may be remotely located from a live dealer, and a live dealer and a game table may be displayed to players on their monitors via a video feed. The players' video feeds may be transmitted to the dealer and may also be shared among the players at the table. In a sample embodiment, a central station may include a plurality of betting-type game devices and an electronic camera for each game device. A plurality of player stations, remotely located with respect to the central station, may each include a monitor, for displaying a selected game device at the central station, and input means, for selecting a game device and for placing a bet by a player at the player's station relating to an action involving an element of chance to occur at the selected game device. Further details on gambling systems and methods for remotely-located players are disclosed in U.S. Pat. No. 6,755,741 B1, issued Jun. 29, 2004, titled "GAMBLING GAME SYSTEM AND METHOD FOR REMOTELY-LOCATED PLAYERS," the disclosure of which is incorporated herein in its entirety by this reference.

Figure 2:
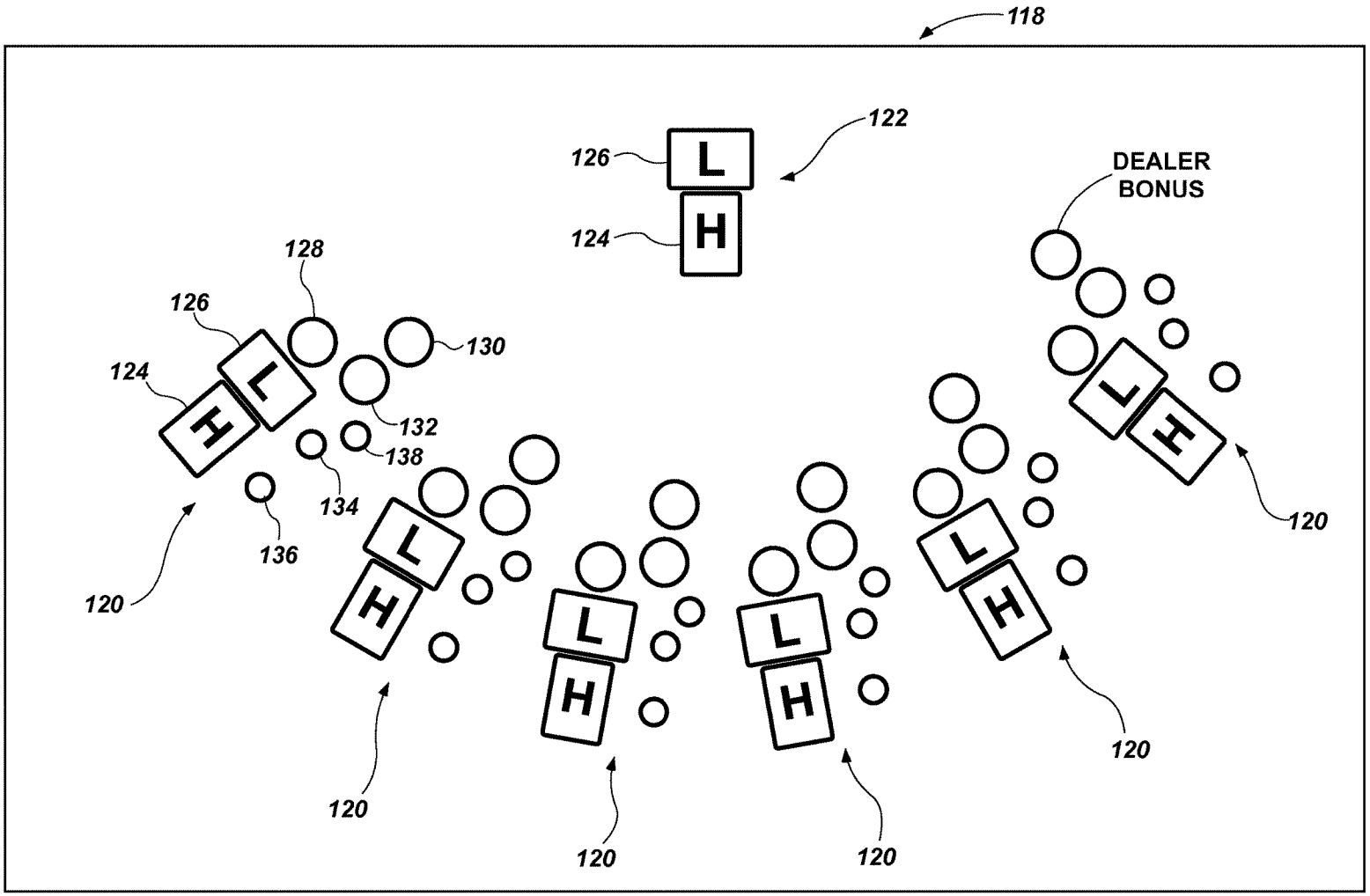
FIG. 2 is a diagram of a playing surface for implementation of a method of administering a wagering game, according to an embodiment of this disclosure.

Referring to FIG. 2, a diagram of a playing surface 118 for implementing wagering games within the scope of this disclosure is shown. Such an implementation may comprise a felt layout on a physical gaming table 400 (FIG. 6) or an electronic representation on a video display 374, 416, 430, 532, 560, 564, 622, or 658 (FIGS. 5 through 8 and 10) for each participating player position 120. The playing surface 118 may include player positions 120 with which players may interact and a dealer position 122 with which the dealer may interact and within each of which the activity (e.g., wagering and card dealing) may take place. The dealer position 122 may include, for example, a high hand area 124 within which cards forming the dealer's high hand may be located and a low hand area 126 within which cards forming the dealer's low hand may be located.

Figure 3:
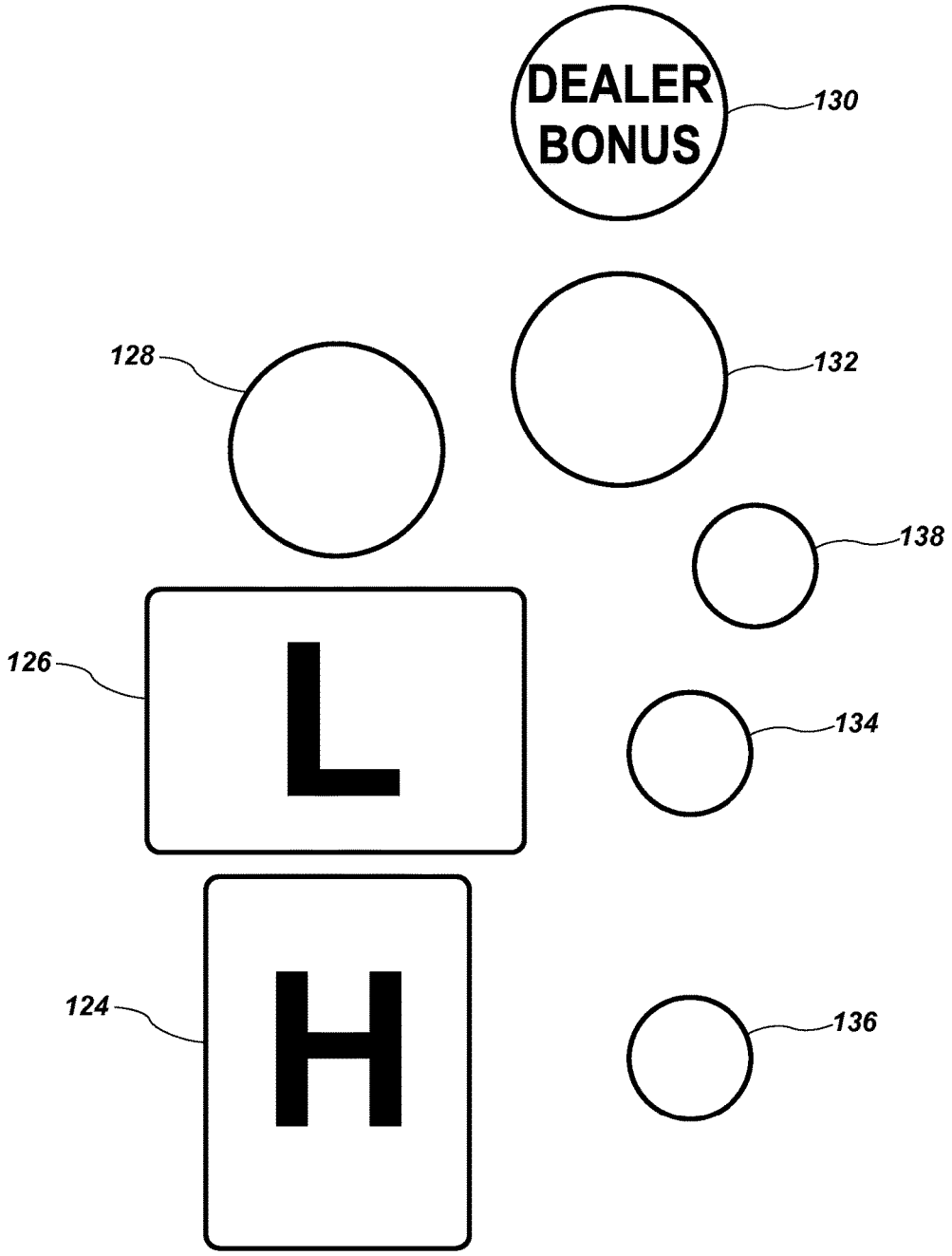
FIG. 3 is an enlarged diagram of a player position of the playing surface of FIG. 2.
Figure 4:
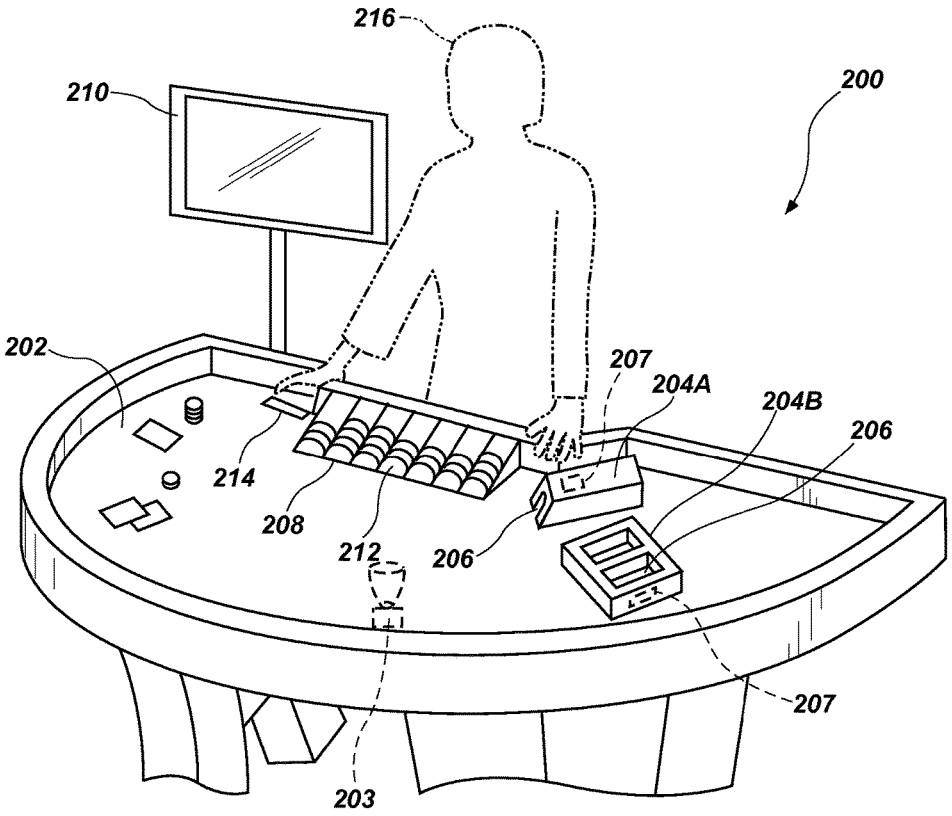
FIG. 4 is a perspective view of a gaming table configured for implementation of embodiments of wagering games in accordance with this disclosure.

Referring to FIG. 3, an enlarged diagram of one of the player positions 120 of the playing surface 118 of FIG. 2 is shown. Each player position 120 may include a high hand area 124 within which cards forming the player's high hand may be located and a low hand area 126 within which cards forming the player's low hand may be located. Each player position may further include an ante wager position 128 within which chips or other wagering elements may be placed or displayed when the ante wager is accepted. A dealer bonus side wager position 130 within which chips or other wagering elements may be placed or displayed when the dealer bonus side wager is accepted may be included in each player position 120. In some embodiments, each player position 120 may include one or more of a fortune side wager position 132, a progressive side wager position 134, a bad beat side wager position 136, and a dealer rank side wager position 138 within each of which chips or other wagering elements may be placed or displayed when each respective wager is accepted.

As described above, each player may arrange the respective seven dealt cards into a five-card high hand and a two-card low hand. The five-card high hand may be received (e.g., placed) in high hand position 124, and the two-card low hand may be received (e.g., placed) in the low hand position 126. Gameplay and resolution of each wager may proceed substantially as described above in connection with FIG. 1. The chips or other wagering elements may be removed from each respective wager position 128, 130, 132, 134, 136, and 138 and given (e.g., physically or electronically transferred) to the player when a respective wager is won, or may be physically or electronically transferred to the dealer or the house when a respective wager is lost.

In some embodiments, the wagering games described herein may be played against a game administrator (i.e., against "the house" such that the game is "house-banked"). Such implementations may involve the game administrator (e.g., a casino or other gaming establishment) accepting (e.g., via a dealer or other agent of the administrator) wagers of real-world monetary value, distributing payouts of real-world monetary value on winning wagers to players, and collecting real-world monetary value of lost wagers. Such "house-banked" embodiments may be implemented, for example, in the form of a live table game, in a virtual table game, in an electronic game, or in a networked (e.g., Internet) game configuration.

In other embodiments, the wagering games, or at least one wager associated with the wagering games, may involve a player in a casino or other gaming establishment acting as banker, accepting wagers having real-world monetary value, issuing payouts having real-world monetary value, and collecting real-world monetary value of lost wagers (i.e., be "player-banked"). In some embodiments where at least one wager is player-banked, the game administrator may collect a player entrance fee, or a rake on each player-banked wager accepted from the participating players, including the banker.

FIG. 4 is a perspective view of an embodiment of a gaming table 200 for implementing wagering games in accordance with this disclosure. The gaming table 200 may be a physical article of furniture around which participants in the wagering game may stand or sit and on which the physical objects used for administering and otherwise participating in the wagering game may be supported, positioned, moved, transferred, and otherwise manipulated. For example, the gaming table 200 may include a gaming surface 202 on which the physical objects used in administering the wagering game may be located. The gaming surface 202 may be, for example, a felt fabric covering a hard surface of the table, and a design, conventionally referred to as a "layout," specific to the game being administered may be physically printed on the gaming surface 202. As another example, the gaming surface 202 may be a surface of a transparent or translucent material (e.g., glass or plexiglass) onto which a projector 203, which may be located, for example, above or below the gaming surface 202, may illuminate a layout specific to the wagering game being administered. In such an example, the specific layout projected onto the gaming surface 202 may be changeable, enabling the gaming table 200 to be used to administer different variations of wagering games within the scope of this disclosure or other wagering games. Additional details of illustrative gaming surfaces and projectors are disclosed in U.S. patent application Ser. No. 13/919,849, filed Jun. 17, 2013, and titled "ELECTRONIC GAMING DISPLAYS, GAMING TABLES INCLUDING ELECTRONIC GAMING DISPLAYS AND RELATED ASSEMBLIES, SYSTEMS AND METHODS," the disclosure of which is incorporated herein in its entirety by this reference. In either example, the gaming surface 202 may include, for example, designated areas for player positions; areas in which one or more of player cards, dealer cards, or community cards may be dealt; areas in which wagers may be accepted; areas in which wagers may be grouped into pots; and areas in which rules, pay tables, and other instructions related to the wagering game may be displayed. As a specific, non-limiting example, the gaming surface 202 may be configured as shown in FIGS. 2 and 3.

In some embodiments, the gaming table 200 may include a display 210 separate from the gaming surface 202. The display 210 may be configured to face players, prospective players, and spectators and may display, for example, rules, paytables, real-time game status, such as wagers accepted and cards dealt, historical game information, such as amounts won, amounts wagered, percentage of hands won, and notable hands achieved, and other instructions and information related to the wagering game. The display 210 may be a physically fixed display, such as a poster, in some embodiments. In other embodiments, the display 210 may change automatically in response to a stimulus (e.g., may be an electronic video monitor).

The gaming table 200 may include particular machines and apparatuses configured to facilitate the administration of the wagering game. For example, the gaming table 200 may include one or more card-handling devices 204. The card-handling device 204A may be, for example, a shoe from which physical cards 206 from one or more decks of playing cards may be withdrawn, one at a time. Such a card-handling device 204A may include, for example, a housing in which cards 206 are located, an opening from which cards 206 are removed, and a card-presenting mechanism (e.g., a moving weight on a ramp configured to push a stack of cards down the ramp) configured to continually present new cards 206 for withdrawal from the shoe. Additional details of an illustrative card-handling device 204A configured as a shoe are found in U.S. Patent App. Pub. No. 2010/0038849, published Feb. 18, 2010, and titled "INTELLIGENT AUTOMATIC SHOE AND CARTRIDGE," the disclosure of which is incorporated herein in its entirety by this reference.

The card-handling device 204B may be, for example, a shuffler configured to reorder physical cards 206 from one or more decks of playing cards and present randomized cards 206 for use in the wagering game. Such a card-handling device 204B may include, for example, a housing, a shuffling mechanism configured to shuffle cards, and card inputs and outputs (e.g., trays). Additional details of an illustrative card-handling device 204B configured as a shuffler are found in U.S. Pat. No. 8,070,574, issued Dec. 6, 2011, to Grauzer et al., the disclosure of which is incorporated herein in its entirety by this reference. Shufflers such as the devices disclosed in the '574 patent may include card recognition capability and may form randomly ordered hands of a known composition within the shuffler. Additionally, game rules may also be programmed within the shuffler such that the processor of the shuffler is capable of identifying a winning hand prior to automatic delivery into an output tray. The card-handling device 204 may also be, for example, a combination shuffler and shoe in which the output for the shuffler is a shoe.

In some embodiments, the card-handling device 204 may be configured and programmed to administer at least a portion of a wagering game being played utilizing the card-handling device 204. For example, the card-handling device 204 may be programmed and configured to randomize a set of cards and present one or more cards for use according to game rules. More specifically, the card-handling device 204 may be programmed and configured to, for example, randomize a set of cards including one or more 52-card decks of standard playing cards and, optionally, any specialty cards (e.g., a cut card, bonus cards, wild cards, or other specialty cards). In some embodiments, the card-handling device 204 may present individual cards, one at a time, for withdrawal from the card-handling device 204. In other embodiments, the card-handling device 204 may present packets of cards representing a subset of the complete set of cards handled by the card-handling device 204 (e.g., individual hands, one hand at a time, a group of hands, a partial hand or hands and then additional cards as needed to complete the hand or hands, a hand or hands and any burn or specialty cards to be used in the same round as the hand or hands) for withdrawal from the card-handling device 204. In some such embodiments, the card-handling device 204 may accept dealer input, such as, for example, a number of replacement cards for discarded cards, a number of hit cards to add, or a number of partial hands to be completed. In other such embodiments, the device may accept a dealer input from a menu of game options indicating a game selection, which will select programming to deliver the requisite number of cards to the game, depending on the game rules. The game rules may be programmed into the memory of the shuffler processing system. In still other embodiments, the card-handling device 204 may present the complete set of randomized cards for withdrawal from the card-handling device 204. As specific, non-limiting examples, the card-handling device 204 may present a packet of cards representing a single hand or a packet of cards representing a group of hands, each hand including seven cards, as described previously in connection with FIG. 1.

Packets of cards used as player hands, partial player hands, dealer hands, partial dealer hands, community cards, or other card groups may be formed internally within the shuffler, such as within an internal compartment, as described in the '574 patent, or may be formed in an output tray of the shuffler. For example, U.S. Pat. No. 6,698,756, issued Mar. 2, 2004, to Baker et al. describes such a device. Other suitable shufflers include U.S. Pat. No. 6,267,248, issued Jul. 31, 2001, to Johnson et al., which describes a shuffler that can form a random set of cards, such as a deck or multiple decks; U.S. Pat. No. 7,766,332, issued Aug. 3, 2010, to Grauzer et al. which describes forming groups of player and/or dealer cards in compartments within a shuffler; U.S. Patent App. Pub. No. 2014/0027979, published Jan. 30, 2014, to Stasson et al., which shows an alternative method of randomly forming a set of cards in a shuffler such as one or more decks of cards; and U.S. Pat. No. 6,588,750, issued Jul. 8, 2003, to Grauzer et al., which shows a device for randomizing a set of cards using a gripping, lifting and insertion sequence. The disclosure of each of the foregoing documents is incorporated herein in its entirety by this reference.

In some embodiments, the card handling device 204 may employ a random number generator device to determine a final card order or an order of insertion of cards into a compartment configured to form a packet of cards. The compartments may be sequentially numbered, and a random number assigned to each compartment number prior to delivery of the first card. In other embodiments, the random number generator may select a location in the stack of cards to separate the stack into two sub-stacks, creating an insertion point within the stack at a random location. The next card may be inserted into the insertion point. In yet other embodiments, the random number generator may randomly select a location in a stack to randomly remove cards by activating an ejector.

Other functions of the random number generator may be game-specific. For example, a random number generator internal or external to the shuffler may be used to randomly select a player to receive a first packet of cards, including a hand or a portion of a hand, according to the game rules. In other examples, the random number generator may select a game position to receive an extra card, one less card, or a random number of cards, depending upon the specific rules of the game.

Regardless of whether the random number generator is hardware or software, it may be used to implement specific game administrations methods of the present disclosure.

The card-handling device 204 may simply be supported on the gaming surface 202 in some embodiments. In other embodiments, the card-handling device 204 may be mounted into the gaming table 202 such that the card-handling device 204 is not manually removable from the gaming table 202 without the use of tools. In some embodiments, the deck or decks of playing cards used may be standard, 52-card decks. In other embodiments, the deck or decks used may include cards, such as, for example, jokers, wild cards, bonus cards, etc. The shuffler may also be configured to handle and dispense security cards, such as cut cards.

In some embodiments, the card-handling device 204 may include an electronic display 207 for displaying information related to the wagering game being administered. For example, the electronic display 207 may display a menu of game options, the name of the game selected, the number of cards per hand to be dispensed, acceptable amounts for wagers (e.g., maximums and minimums), numbers of cards to be dealt to recipients, locations of particular recipients for particular cards, winning and losing wagers, pay tables, winning hands, losing hands, and payout amounts. In other embodiments, information related to the wagering game may be displayed on another electronic display, such as, for example, the display 210 described previously.

The type of card-handling device 204 employed to administer embodiments of the disclosed wagering game, as well as the type of card deck employed and the number of decks, may be specific to the game to be implemented. For example, the card-handling device 204 may be configured to shuffle at least a physical deck of 52 standard playing cards, or a 53-card deck including a standard 52-card deck of playing cards and one wild or semi-wild joker. In some embodiments, additional cards may further be included in the deck, e.g., one or more jokers or security cards such as a cut card. As a specific, non-limiting example, the card-handling device 204 may be a card shuffler or a combination card shuffler and shoe configured to randomize and present cards (e.g., in groups or one at a time) from at least a 52- or 53-card deck of physical cards as described above.

The gaming table 200 may include one or more chip racks 208 configured to facilitate accepting wagers, transferring lost wagers to the house, and exchanging monetary value for wagering elements 212 (e.g., chips). For example, the chip rack 208 may include a series of token support rows, each of which may support tokens of a different type (e.g., color and denomination). In some embodiments, the chip rack 208 may be configured to automatically present a selected number of chips using a chip-cutting-and-delivery mechanism. Additional details of an illustrative chip rack 208 and chip-cutting-and-delivery mechanism are found in U.S. Pat. No. 7,934,980, issued May 3, 2011, to Blaha et al., the disclosure of which is incorporated herein in its entirety by this reference. In some embodiments, the gaming table 200 may include a drop box 214 for money that is accepted in exchange for wagering elements 212. The drop box 214 may be, for example, a secure container (e.g., a safe or lockbox) having a one-way opening into which money may be inserted and a secure, lockable opening from which money may be retrieved. Such drop boxes 214 are known in the art, and may be incorporated directly into the gaming table 200 and may, in some embodiments, have a removable container for the retrieval of money in a separate, secure location.

When administering a wagering game in accordance with embodiments of this disclosure, a dealer 216 may receive money (e.g., cash) from a player in exchange for wagering elements 212. The dealer 216 may deposit the money in the drop box 214 and transfer physical wagering elements 212 to the player. The dealer 216 may accept one or more initial wagers (e.g., antes and other wagers) from the player, which may be reflected by the dealer 216 permitting the player to place one or more wagering elements 212 or other wagering tokens (e.g., cash) within designated areas on the gaming surface 202 associated with the various wagers of the wagering game. Once initial wagers have been accepted, the dealer 216 may remove physical cards 206 from the card-handling device 204 (e.g., individual cards, packets of cards, or the complete set of cards) in some embodiments. In other embodiments, the physical cards 206 may be hand-pitched (i.e., the dealer may optionally shuffle the cards 206 to randomize the set and may hand-deal cards 206 from the randomized set of cards). The dealer may position cards 206 within designated areas on the gaming surface 202, which may designate the cards 206 for use as individual player cards, community cards, or dealer cards in accordance with game rules. House rules also may allow the player to place wagers during card distribution, or after card distribution, but before revealing the cards.

After dealing the cards 206, and during play, according to the game rules, any additional wagers (e.g., play bets) may be accepted, which may be reflected by the dealer 216 permitting the player to place one or more wagering elements 212 within designated areas on the gaming surface 202 associated with the various wagers of the wagering game. In some embodiments, a player may fold, which may result in the dealer 216 collecting at least one of the wagering elements 212 from that player and transferring it to the house, which may be reflected by the wagering element 212 being returned to the chip rack 208. The dealer 216 may perform any additional card dealing and rounds of betting permitted in the wagering game. Finally, the dealer 216 may resolve the wagers, award winning wagers to the players, which may be accomplished by giving wagering elements 212 from the chip rack 208 to the players, and transferring losing wagers to the house, which may be accomplished by moving wagering elements 212 from the players to the chip rack 208.

Figure 5:
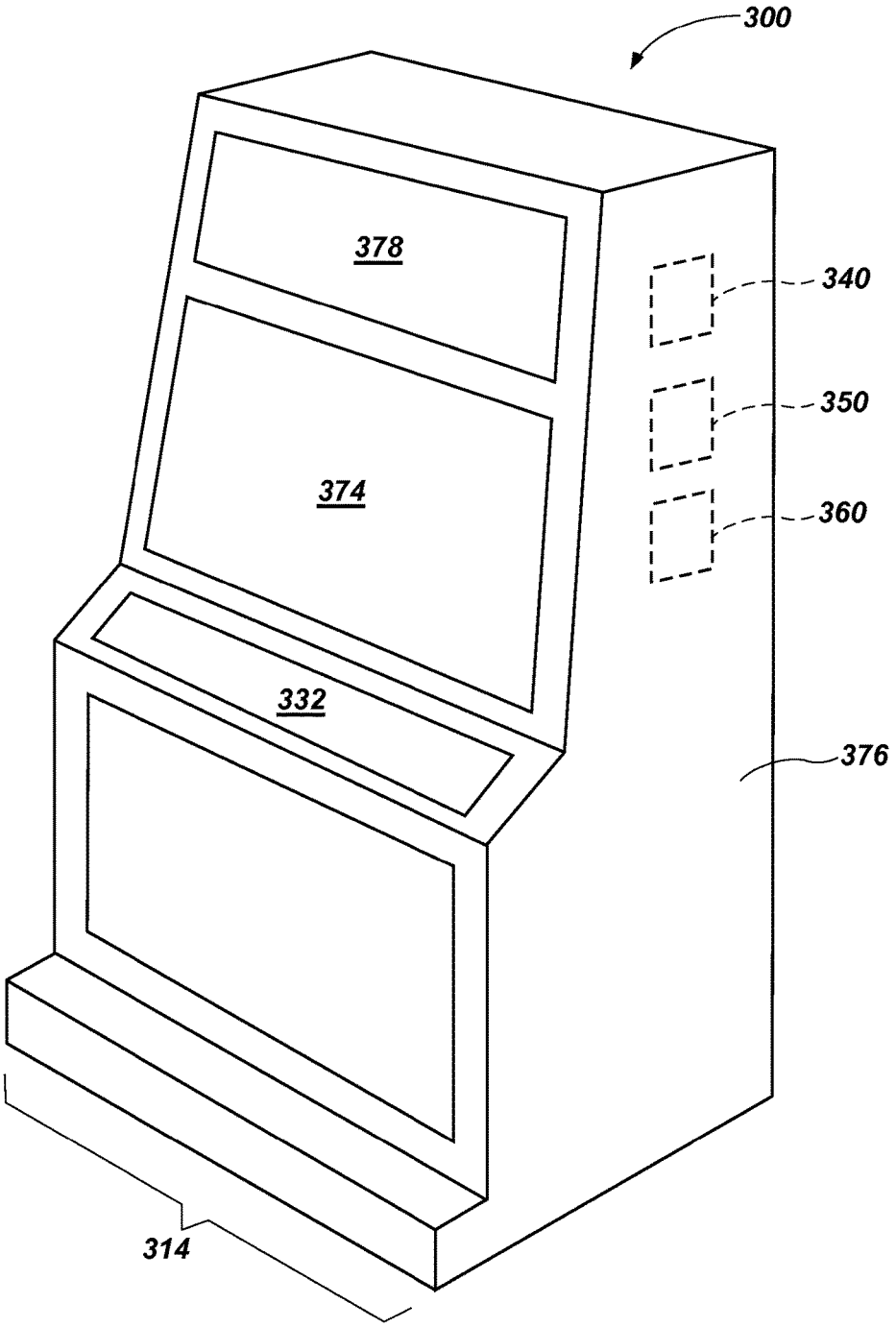
FIG. 5 is a perspective view of an individual electronic gaming device configured for implementation of embodiments of wagering games in accordance with this disclosure.

FIG. 5 is a perspective view of an individual electronic gaming device 300 (e.g., an electronic gaming machine (EGM)) configured for implementing wagering games according to this disclosure. The individual electronic gaming device 300 may include an individual player position 314 including a player input area 332 configured to enable a player to interact with the individual electronic gaming device 300 through various input devices (e.g., buttons, levers, touchscreens). The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving physical playing cards, chips or other wagering elements, and live personnel. The action may instead be simulated by a control processor 350 operably coupled to the memory 340 and interacting with and controlling the individual electronic gaming device 300.

Although the individual electronic gaming device 300 displayed in FIG. 5 has an outline of a traditional gaming cabinet, the individual electronic gaming device 300 may be implemented in other ways, such as, for example, client software downloaded to a portable device, such as a smart phone, tablet, or laptop computer. The individual electronic gaming device 300 may also be a non-portable personal computer (e.g., a desktop or all-in-one computer) or other computing device. In some embodiments, client software is not downloaded but is native to the device or is otherwise delivered with the device when distributed.

A communication device 360 may be included and operably coupled to the processor 350 such that information related to operation of the individual electronic gaming device 300, information related to the game play, or combinations thereof may be communicated between the individual electronic gaming device 300 and other devices, such as a server, through a suitable communication medium, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners to communicate rules of game play and the like, such as along a top portion 378 of the cabinet 376 of the individual electronic gaming device 300. The individual electronic gaming device 300 may further include additional decorative lights (not shown), and speakers (not shown) for transmitting and optionally receiving sounds during game play. Further detail of an example of an individual electronic gaming device 300 (as well as other embodiments of tables and devices) is disclosed in U.S. patent application Ser. No. 13/963,165, filed Aug. 9, 2013, and titled "METHODS AND SYSTEMS FOR ELECTRONIC GAMING," the disclosure of which is incorporated herein in its entirety by this reference.

Some embodiments may be implemented at locations including a plurality of player stations. Such player stations may include an electronic display screen for display of game information (e.g., cards, wagers, and game instructions) and for accepting wagers and facilitating credit balance adjustments. Such player stations may, optionally, be integrated in a table format, may be distributed throughout a casino or other gaming site, or may include both grouped and distributed player stations.

FIG. 6 is a top view of a suitable table 400 configured for implementing wagering games according to this disclosure. The table 400 may include a playing surface 404. The table 400 may include player stations 412. Each player station 412 may include a player interface 416, which may be used for displaying game information (e.g., game instructions, input options, wager information, game outcomes, etc.) and accepting player elections. The player interface 416 may be a display screen in the form of a touch screen, which may be at least substantially flush with the playing surface 404 in some embodiments. Each player interface 416 may be operated by its own local game processor 414 (shown in dashed lines), although, in some embodiments, a central game processor 428 (shown in dashed lines) may be employed and may communicate directly with player interfaces 416. In some embodiments, a combination of individual local game processors 414 and the central game processor 428 may be employed. Each of the processors 414 and 428 may be operably coupled to memory including one or more programs related to the rules of game play at the table 400.

A communication device 460 may be included and may be operably coupled to one or more of the local game processors 414, the central game processor 428, or combinations thereof, such that information related to operation of the table 400, information related to the game play, or combinations thereof may be communicated between the table 400 and other devices through a suitable communication medium, such as, for example, wired networks, Wi-Fi networks, and cellular communication networks.

The table 400 may further include additional features, such as a dealer chip tray 420, which may be used by the dealer to cash players in and out of the wagering game, whereas wagers and balance adjustments during game play may be performed using, for example, virtual chips (e.g., images or text representing wagers). For embodiments using physical cards 406*a* and 406*b*, the table 400 may further include a card-handling device 422, which may be configured to shuffle, read, and deliver physical cards for the dealer and players to use during game play or, alternatively, a card shoe configured to read and deliver cards that have already been randomized. For embodiments using virtual cards, the virtual cards may be displayed at the individual player interfaces 416. Common virtual cards may be displayed in a common card area.

The table 400 may further include a dealer interface 418, which, like the player interfaces 416, may include touch screen controls for receiving dealer inputs and assisting the dealer in administering the wagering game. The table 400 may further include an upright display 430 configured to display images that depict game information such as pay tables, hand counts, historical win/loss information by player, and a wide variety of other information considered useful to the players. The upright display 430 may be double sided to provide such information to players as well as to casino personnel.

Further detail of an example of a table and player displays is disclosed in U.S. Pat. No. 8,262,475, issued Sep. 11, 2012, and titled "CHIPLESS TABLE SPLIT SCREEN FEATURE," the disclosure of which is incorporated herein in its entirety by this reference. Although an embodiment is described showing individual discrete player stations, in some embodiments, the entire playing surface 404 may be an electronic display that is logically partitioned to permit game play from a plurality of players for receiving inputs from, and displaying game information to, the players, the dealer, or both.

FIG. 7 is a perspective view of another embodiment of a suitable table 500 configured for implementing wagering games according to the present disclosure utilizing a virtual dealer. The table 500 may include player positions 514 arranged in a bank about an arcuate edge 520 of a video device 558 that may comprise a card screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The card screen 564 may be configured to display at least one or more of the dealer's cards, any community cards, and player's cards by the virtual dealer on the dealer screen 560.

Each of the player positions 514 may include a player interface area 532 configured for wagering and game play interactions with the video device 558 and virtual dealer. Accordingly, game play may be accommodated without involving physical playing cards, poker chips, and live personnel. The action may instead be simulated by a control processor 597 interacting with and controlling the video device 558. The control processor 597 may be programmed, by known techniques, to implement the rules of game play at the video device 558. As such, the control processor 597 may interact and communicate with display/input interfaces and data entry inputs for each player interface area 532 of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices, such as a central server, through a suitable communication medium, such, as, for example, wired networks, Wi-Fi networks, and cellular communication networks.

The video device 558 may further include banners communicating rules of play and the like, which may be located along one or more walls 570 of the cabinet 562. The video device 558 may further include additional decorative lights and speakers, which may be located on an underside surface 566, for example, of a generally horizontally extending top 568 of the cabinet 562 of the video device 558 generally extending toward the player positions 514.

Further detail of an example of a table and player displays is disclosed in U.S. Pat. No. 8,272,958, issued Sep. 25, 2012, and titled "AUTOMATED MULTIPLAYER GAME TABLE WITH UNIQUE IMAGE FEED OF DEALER," the disclosure of which is incorporated herein in its entirety by this reference. Although an embodiment is described showing individual discrete player stations, in some embodiments, the entire playing surface (e.g., player interface areas 532, card screen 564, etc.) may be a unitary electronic display that is logically partitioned to permit game play from a plurality of players for receiving inputs from, and displaying game information to, the players, the dealer, or both.

Figure 8:
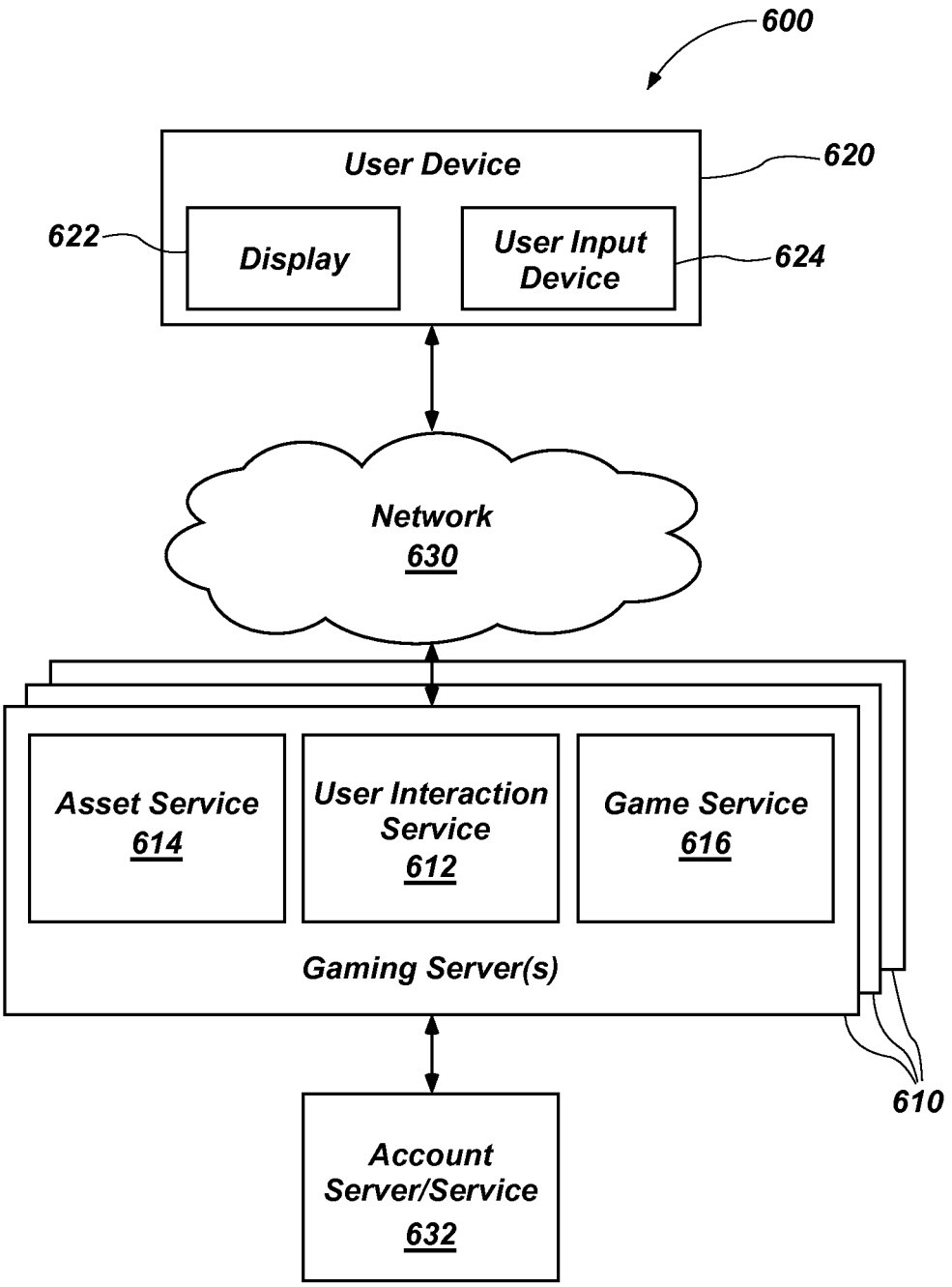
FIG. 8 is a schematic block diagram of a gaming system for implementing embodiments of waging games in accordance with this disclosure.

In some embodiments, wagering games in accordance with this disclosure may be administered using a gaming system employing a client-server architecture (e.g., over the Internet, a local area network, etc.). FIG. 8 is a schematic block diagram of an illustrative gaming system 600 for implementing wagering games according to this disclosure. The gaming system 600 may enable end users to remotely access game content. Such game content may include, without limitation, various types of wagering games such as card games, dice games, big wheel games, roulette, scratch off games ("scratchers"), and any other wagering game where the game outcome is determined, in whole or in part, by one or more random events. This includes, but is not limited to, Class II and Class III games as defined under 25 U.S.C. § 2701 et seq. ("Indian Gaming Regulatory Act"). Such games may include banked and/or non-banked games.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform to establish a portal for an end user to access a wagering game hosted by one or more gaming servers 610 over a network 630. In some embodiments, games are accessed through a user interaction service 612. The gaming system 600 enables players to interact with a user device 620 through a user input device 624 and a display 622 and to communicate with one or more gaming servers 610 using a network 630 (e.g., the Internet). Typically, the user device 620 is remote from the gaming server 610 and the network is the word-wide web (i.e., the Internet).

In some embodiments, the gaming servers 610 may be configured as a single server to administer wagering games in combination with the user device 620. In other embodiments, the gaming servers 610 may be configured as separate servers for performing separate, dedicated functions associated with administering wagering games. Accordingly, the following description also discusses "services" with the understanding that the various services may be performed by different servers or combinations of servers in different embodiments. As shown in FIG. 8, the gaming servers 610 may include a user interaction service 612, a game service 616, and an asset service 614. In some embodiments, one or more of the gaming servers 610 may communicate with an account server 632 performing an account service 632. As explained more fully below, for some wagering type games, the account service 632 may be separate and operated by a different entity than the gaming servers 610; however, in some embodiments the account service 632 may also be operated one or more of the gaming servers 610.

The user device 620 may communicate with the user interaction service 612 through the network 630. The user interaction service 612 may communicate with the game service 616 and provide game information to the user device 620. In some embodiments, the game service 616 may also include a game engine. The game engine may, for example, access, interpret, and apply game rules. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the gaming servers 610. The client provided by the gaming servers 610 for execution on the user device 620 may be any of a variety of implementations depending on the user device 620 and method of communication with the gaming servers 610. In one embodiment, the user device 620 may connect to the gaming servers 610 using a web browser, and the client may execute within a browser window or frame of the web browser. In another embodiment, the client may be a stand-alone executable on the user device 620.

For example, the client may comprise a relatively small amount of script (e.g., JAVASCRIPT®), also referred to as a "script driver," including scripting language that controls an interface of the client. The script driver may include simple function calls requesting information from the gaming servers 610. In other words, the script driver stored in the client may merely include calls to functions that are externally defined by, and executed by, the gaming servers 610. As a result, the client may be characterized as a "thin client." The client may simply send requests to the gaming servers 610 rather than performing logic itself. The client may receive player inputs, and the player inputs may be passed to the gaming servers 610 for processing and executing the wagering game. In some embodiments, this may involve providing specific graphical display information for the display 622 as well as game outcomes.

As another example, the client may comprise an executable file rather than a script. The client may do more local processing than does a script driver, such as calculating where to show what game symbols upon receiving a game outcome from the game service 616 through user interaction service 612. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as, for example, the Internet or a local area network.

The gaming servers 610 may include an asset service 614, which may host various media assets (e.g., text, audio, video, and image files) to send to the user device 620 for presenting the various wagering games to the end user. In other words, the assets presented to the end user may be stored separately from the user device 620. For example, the user device 620 requests the assets appropriate for the game played by the user; as another example, especially relating to thin clients, just those assets that are needed for a particular display event will be sent by the gaming servers 610, including as few as one asset. The user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 and to different variations of wagering games.

The gaming servers 610 may include the game service 616, which may be programmed to administer wagering games and determine game play outcomes to provide to the user interaction service 612 for transmission to the user device 620. For example, the game service 616 may include game rules for one or more wagering games, such that the game service 616 controls some or all of the game flow for a selected wagering game as well as the determined game outcomes. The game service 616 may include pay tables and other game logic. The game service 616 may perform random number generation for determining random game elements of the wagering game. In one embodiment, the game service 616 may be separated from the user interaction service 612 by a firewall or other method of preventing unauthorized access to the game service 612 by the general members of the network 630.

The user device 620 may present a gaming interface to the player and communicate the user interaction from the user input device 624 to the gaming servers 610. The user device 620 may be any electronic system capable of displaying gaming information, receiving user input, and communicating the user input to the gaming servers 610. For example, the user device 620 may be a desktop computer, a laptop, a tablet computer, a set-top box, a mobile device (e.g., a smartphone), a kiosk, a terminal, or another computing device. As a specific, non-limiting example, the user device 620 operating the client may be an interactive electronic gaming system 300 (see FIG. 5), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 610. The client may be illustrated within a casino webpage (or other interface) indicating that the client is embedded into a webpage, which is supported by a web browser executing on the user device 620.

In some embodiments, components of the gaming system 600 may be operated by different entities. For example, the user device 620 may be operated by a third party, such as a casino or an individual, that links to the gaming servers 610, which may be operated, for example, by a wagering game service provider. Therefore, in some embodiments, the user device 620 and client may be operated by a different administrator than the operator of the game service 616. In other words, the user device 620 may be part of a third-party system that does not administer or otherwise control the gaming servers 610 or game service 616. In other embodiments, the user interaction service 612 and asset service 614 may be operated by a third-party system. For example, a gaming entity (e.g., a casino) may operate the user interaction service 612, user device 620, or combination thereof to provide its customers access to game content managed by a different entity that may control the game service 616, amongst other functionality. In still other embodiments, all functions may be operated by the same administrator. For example, a gaming entity (e.g., a casino) may elect to perform each of these functions in-house, such as providing access to the user device 620, delivering the actual game content, and administering the gaming system 600.

The gaming servers 610 may communicate with one or more external account servers 632 (also referred to herein as an account service 632), optionally through another firewall. For example, the gaming servers 610 may not directly accept wagers or issue payouts. That is, the gaming servers 610 may facilitate online casino gaming but may not be part of a self-contained online casino itself. Another entity (e.g., a casino or any account holder or financial system of record) may operate and maintain its external account service 632 to accept bets and make payout distributions. The gaming servers 610 may communicate with the account service 632 to verify the existence of funds for wagering and to instruct the account service 632 to execute debits and credits. As another example, the gaming servers 610 may directly accept bets and make payout distributions, such as in the case where an administrator of the gaming servers 610 operates as a casino.

Additional features may be supported by the gaming servers 610, such as hacking and cheating detection, data storage and archival, metrics generation, messages generation, output formatting for different end user devices, as well as other features and operations. For example, the gaming servers 610 may include additional features and configurations as described in U.S. patent application Ser. No. 13/353,194, filed Jan. 18, 2012, and U.S. patent application Ser. No. 13/609,031, filed Sep. 10, 2012, both applications titled "NETWORK GAMING ARCHITECTURE, GAMING SYSTEMS, AND RELATED METHODS," the disclosure of each of which is incorporated herein in its entirety by this reference.

Figure 9:
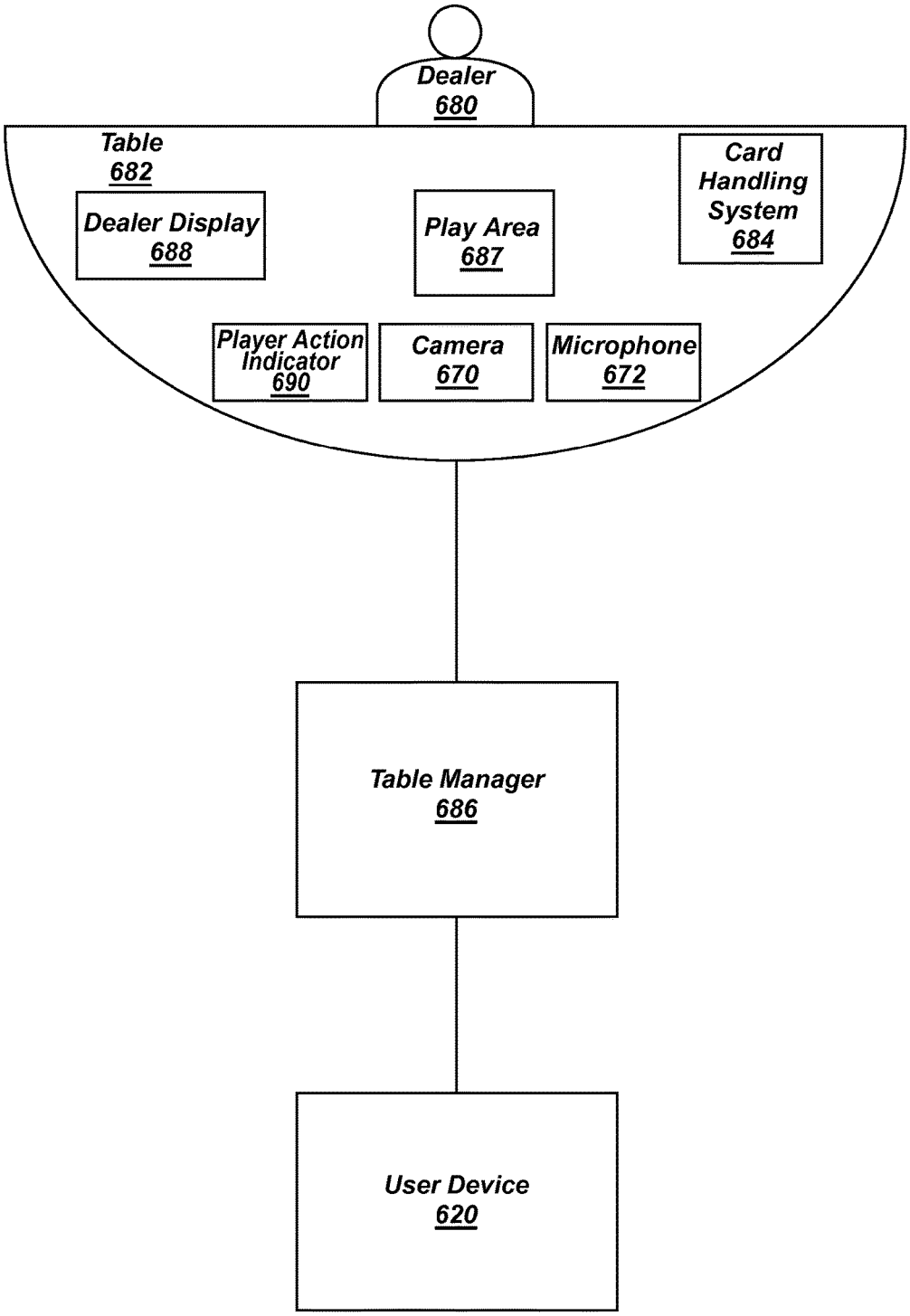
FIG. 9 is a schematic block diagram of a gaming system for implementing embodiments of wagering games including a live dealer feed.

FIG. 9 is a schematic block diagram of a table 682 for implementing wagering games including a live dealer feed. Features of the gaming system 600 (see FIG. 8) described above in connection with FIG. 8 may be utilized in connection with this embodiment, except as further described. Rather than cards being determined by a computerized random processes, physical cards (e.g., from a standard, 52-card deck of playing cards) may be dealt by a live dealer 680 at a table 682 from a card handling system 684. A table manager 686 may assist the dealer 680 in facilitating play of the game by transmitting a video feed of the dealer's actions to the user device 620 and transmitting player elections to the dealer 680. As described above, the table manager 686 may act as or communicate with a gaming system 600 (see FIG. 8) (e.g., acting as the gaming system 600 (see FIG. 8) itself or as an intermediate client interposed between and operationally connected to the user device 620 and the gaming system 600 (see FIG. 8)) to provide gaming at the table 682 to users of the gaming system 600 (see FIG. 8). Thus, the table manager 686 may communicate with the user device 620 through a network 630 (see FIG. 8), and may be a part of a larger online casino, or may be operated as a separate system facilitating game play. In various embodiments, each table 682 may be managed by an individual table manager 686 constituting a gaming device, which may receive and process information relating to that table. For simplicity of description, these functions are described as being performed by the table manager 686, though certain functions may be performed by an intermediary gaming system 600 (see FIG. 8), such as the one shown and described in connection with FIG. 8. In some embodiments, the gaming system 600 (see FIG. 8) may match remotely located players to tables 682 and facilitate transfer of information between user devices 620 and tables 682, such as wagering amounts and player option elections, without managing gameplay at individual tables. In other embodiments, functions of the table manager 686 may be incorporated into a gaming system 600 (see FIG. 8).

The table 682 includes a camera 670 and optionally a microphone 672 to capture video and audio feeds relating to the table 682. The camera 670 may be trained on the dealer 680, play area 687, and card handling system 684. As the game is administered by the dealer 680, the video feed captured by the camera 670 may be shown to the player using the user device 620, and any audio captured by the microphone 672 may be played to the player using the user device 620. In some embodiments, the user device 620 may also include a camera, microphone, or both, which may also capture feeds to be shared with the dealer 680 and other players. In some embodiments, the camera 670 may be trained to capture images of the card faces, chips, and chip stacks on the surface of the gaming table. Known image extraction techniques may be used to obtain card count and card rank and suit information from the card images. An example of suitable image extraction software is disclosed in U.S. Pat. No. 7,901,285, issued Mar. 8, 2011, to Tran et al., the disclosure of which is incorporated in this disclosure in its entirety by this reference.

Card and wager data in some embodiments may be used by the table manager 686 to determine game outcome. The data extracted from the camera 670 may be used to confirm the card data obtained from the card handling system 684, to determine a player position that received a card, and for general security monitoring purposes, such as detecting player or dealer card switching, for example. Examples of card data include, for example, suit and rank information of a card, suit and rank information of each card in a hand, rank information of a hand, and rank information of every hand in a round of play.

The live video feed permits the dealer to show cards dealt by the card handling system and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

The card handling system 684 may be as shown and described previously in connection with FIG. 4. The play area 687 depicts player positions for playing the game, such as shown in FIGS. 2 and 3. As determined by the rules of the game, the player at the user device 620 may be presented options for responding to an event in the game using a client as described with reference to FIG. 8.

Player elections may be transmitted to the table manager 686, which may display player elections to the dealer 680 using a dealer display 688 and player action indicator 690 on the table 682. For example, the dealer display 688 may display information regarding where to deal the next card or which player position is responsible for the next action.

In some embodiments, the table manager 686 may receive card information from the card handling system 684 to identify cards dealt by the card handling system 684. For example, the card handling system 684 may include a card reader to determine card information from the cards. The card information may include the rank and suit of each dealt card and hand information.

The table manager 686 may apply game rules to the card information, along with the accepted player decisions, to determine gameplay events and wager results. Alternatively, the wager results may be determined by the dealer 680 and input to the table manager 686, which may be used to confirm automatically determined results by the gaming system.

Card and wager data in some embodiments may be used by the table manager 686 to determine game outcome. The data extracted from the camera 670 may be used to confirm the card data obtained from the card handling system 684, to determine a player position that received a card, and for general security monitoring purposes, such as detecting player or dealer card switching, for example.

The live video feed permits the dealer to show cards dealt by the card handling system and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

Figure 10:
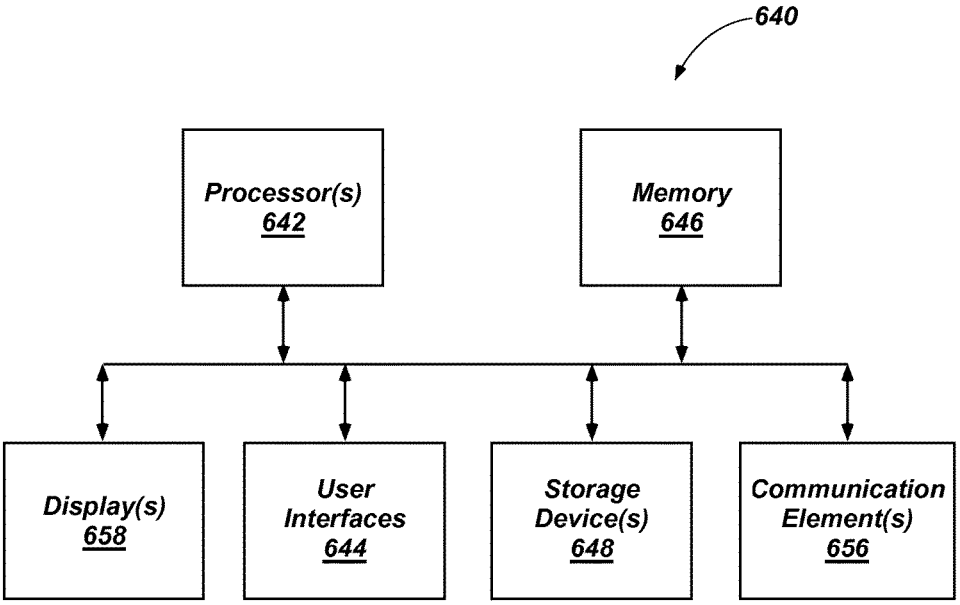
FIG. 10 is a block diagram of a computer for acting as a gaming system for implementing embodiments of wagering games in accordance with this disclosure.

FIG. 10 is a simplified block diagram showing elements of computing devices that may be used in systems and apparatuses of this disclosure. The computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured to execute a wide variety of operating systems and applications including the computing instructions for administering wagering games of the present disclosure.

The processors 642 may be configured as a general-purpose processor such as a microprocessor, but in the alternative, the general-purpose processor may be any processor, controller, microcontroller, or state machine suitable for carrying out processes of the present disclosure. The processor 642 may also be implemented as a combination of computing devices, such as a combination of a DSP and a microprocessor, a plurality of microprocessors, one or more microprocessors in conjunction with a DSP core, or any other such configuration.

A general-purpose processor may be part of a general-purpose computer. However, when configured to execute instructions (e.g., software code) for carrying out embodiments of the present disclosure the general-purpose computer should be considered a special-purpose computer. Moreover, when configured according to embodiments of the present disclosure, such a special-purpose computer improves the function of a general-purpose computer because, absent the present disclosure, the general-purpose computer would not be able to carry out the processes of the present disclosure. The processes of the present disclosure, when carried out by the special-purpose computer, are processes that a human would not be able to perform in a reasonable amount of time due to the complexities of the data processing, decision making, communication, interactive nature, or combinations thereof for the present disclosure. The present disclosure also provides meaningful limitations in one or more particular technical environments that go beyond an abstract idea. For example, embodiments of the present disclosure provide improvements in the technical field related to the present disclosure.

The memory 646 may be used to hold computing instructions, data, and other information for performing a wide variety of tasks including administering wagering games of the present disclosure. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light emitting diode displays, liquid crystal displays, cathode ray tubes, and the like. In addition, the display 658 may be configured with a touch-screen feature for accepting user input as a user interface element 644.

As non-limiting examples, the user interface elements 644 may include elements such as displays, keyboards, push-buttons, mice, joysticks, haptic devices, microphones, speakers, cameras, and touchscreens.

As non-limiting examples, the communication elements 656 may be configured for communicating with other devices or communication networks. As non-limiting examples, the communication elements 656 may include elements for communicating on wired and wireless communication media, such as for example, serial ports, parallel ports, Ethernet connections, universal serial bus (USB) connections, IEEE 1394 ("firewire") connections, THUNDERBOLT™ connections, BLUETOOTH® wireless networks, ZIGBEE® wireless networks, 802.11 type wireless networks, cellular telephone/data networks, and other suitable communication interfaces and protocols.

The storage 648 may be used for storing relatively large amounts of nonvolatile information for use in the computing system 640 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one non-limiting example, the memory 646 may be divided into cache memory, graphics memory, and main memory. Each of these memories may communicate directly or indirectly with the one or more processors 642 on separate buses, partially-combined buses, or a common bus.

As a specific, non-limiting example, various methods and features of the present disclosure may be implemented in a mobile, remote, or mobile and remote environment over one or more of Internet, cellular communication (e.g. Broadband), near field communication networks and other communication networks referred to collectively herein as an iGaming environment. The iGaming environment may be accessed through social media environments such as FACEBOOK® and the like. DragonPlay Ltd, acquired by Bally Technologies Inc., provides an example of a platform to provide games to user devices, such as cellular telephones and other devices utilizing ANDROID®, IPHONE® and FACEBOOK® platforms. Where permitted by jurisdiction, the iGaming environment can include pay-to-play (P2P) gaming where a player, from their device, can make value based wagers and receive value based awards. Where P2P is not permitted, the features can be expressed as entertainment only gaming where players wager virtual credits having no value or risk no wager whatsoever such as playing a promotion game or feature.

Figure 11:
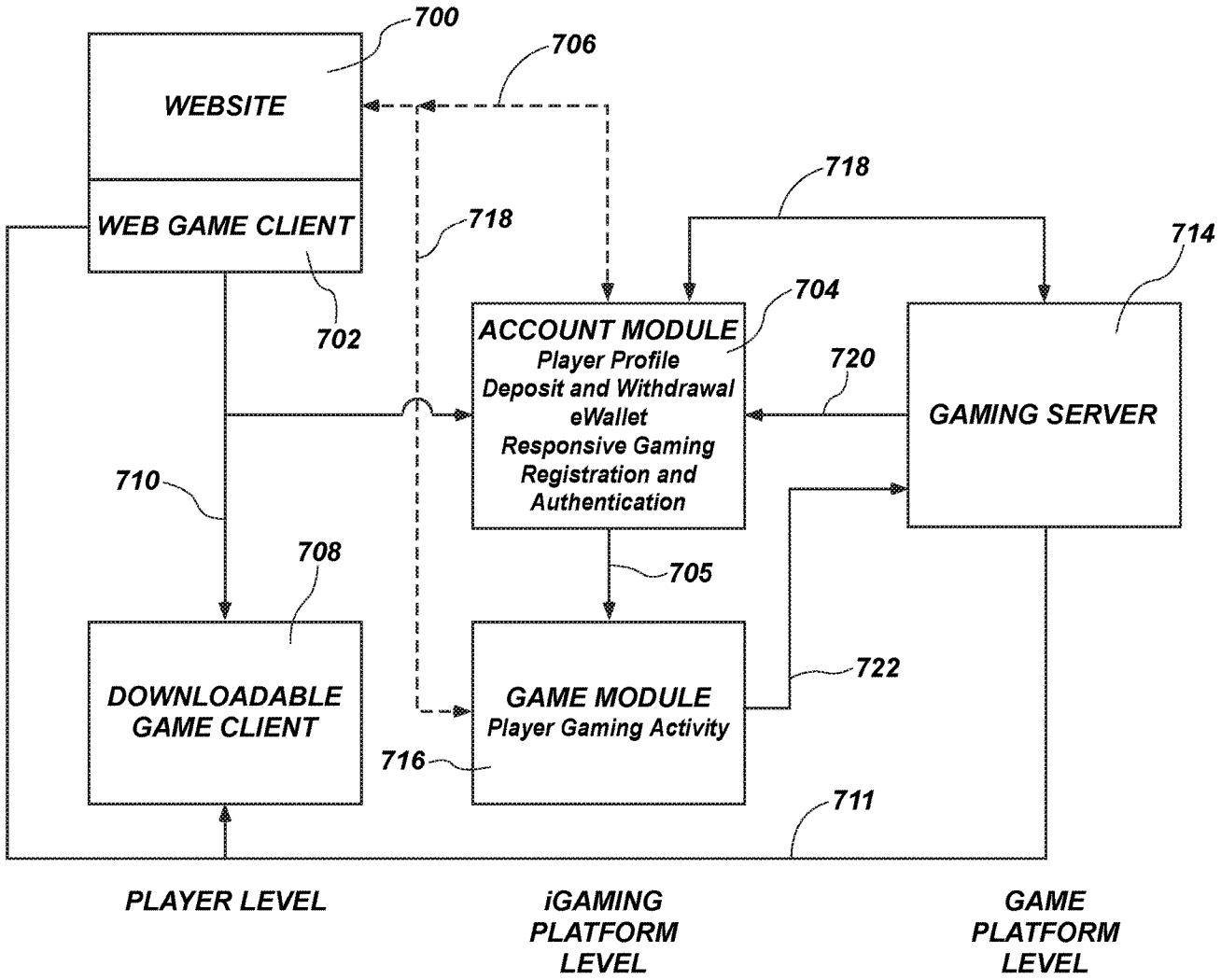
FIG. 11 illustrates an embodiment of data flows between various applications/services for supporting the game, feature or utility of the present invention for mobile/interactive gaming.

FIG. 11 illustrates an illustrative embodiment of information flows in an iGaming environment. At a player level, the player or user accesses a site hosting the activity such as a website 700. The website 700 may functionally provide a web game client 702. The web game client 702 may be, for example, represented by a game client 708 downloadable at information flow 710, which may process applets transmitted from a gaming server 714 at information flow 711 for rendering and processing game play at a player's remote device. Where the game is a P2P game, the gaming server 714 may process value-based wagers (e.g. money wagers) and randomly generate an outcome for rendition at the player's device. In some embodiments, the web game client 702 may access a local memory store to drive the graphic display at the player's device. In other embodiments, all or a portion of the game graphics may be streamed to the player's device with the web game client 702 enabling player interaction and display of game features and outcomes at the player's device.

The website 700 may access a player-centric, iGaming-platform-level account module 704 at information flow 706 for the player to establish and confirm credentials for play and, where permitted, access an account (e.g., an eWallet) for wagering. The account module may include or access data related to the player's profile (e.g., player-centric information desired to be retained and tracked by the host), the player's electronic account, deposit, and withdrawal records, registration and authentication information, such as username and password, name and address information, date of birth, a copy of a government issued identification document, such as a driver's license or passport, and biometric identification criteria, such as fingerprint or facial recognition data, and a responsible gaming module containing information, such as self-imposed or jurisdictionally imposed gaming restraints, such as loss limits, daily limits, and duration limits. The account module 704 may also contain and enforce geo-location limits, such as geographic areas where the player may play P2P games, user device IP address confirmation, and the like.

The account module 704 communicates at information flow 705 with a game module 716 to complete log-ins, registrations, and other activities. The game module 716 may also store or access a player's gaming history, such as player tracking and loyalty club account information. The game module 716 may provide static web pages to the player's device from the game module 716 through information flow 718, whereas, as stated above, the live game content may be provided from the gaming server 714 to the web game client through information flow 711.

The gaming server 714 may be configured to provide interaction between the game and the player, such as receiving wager information, game selection, inter-game player selections or choices to play a game to its conclusion, and the random selection of game outcomes and graphics packages, which, alone or in conjunction with the downloadable game client 708/web game client 702 and game module 716, provide for the display of game graphics and player interactive interfaces. At information flow 718 player account and log-in information may be provided to the gaming server 714 from the account module 704 to enable gaming. Information flow 720 provides wager/credit information between the account module 704 and gaming server 714 for the play of the game and may display credits and eWallet availability. Information flow 722 may provide player tracking information for the gaming server 714 for tracking the player's play. The tracking of play may be used for purposes of providing loyalty rewards to a player, determining preferences, and the like.

All or portions of the features of FIG. 11 may be supported by servers and databases located remotely from a player's mobile device and may be hosted or sponsored by regulated gaming entity for P2P gaming or, where P2P is not permitted, for entertainment only play.

In some embodiments, wagering games may be administered in an at least partially player-pooled format, with payouts on pooled wagers being paid from a pot to players and losses on wagers being collected into the pot and eventually distributed to one or more players. Such player-pooled embodiments may include a player-pooled progressive embodiment, in which a pot is eventually distributed when a predetermined progressive-winning hand combination or composition is dealt. Player-pooled embodiments may also include a dividend refund embodiment, in which at least a portion of the pot is eventually distributed in the form of a refund distributed, e.g., pro-rata, to the players who contributed to the pot.

In some player-pooled embodiments, the game administrator may not obtain profits from chance-based events occurring in the wagering games that result in lost wagers. Instead, lost wagers may be redistributed back to the players. To profit from the wagering game, the game administrator may retain, for example, a player entrance fee or a rake taken on wagers, such that the amount obtained by the game administrator in exchange for hosting the wagering game is not based on the chance events occurring in the wagering game itself. The game administrator may also charge a rent of flat fee to participate. Specific, illustrative mechanisms for redistributing the lost wagers back to players are described in connection with FIGS. 12 and 13.

Figure 12:
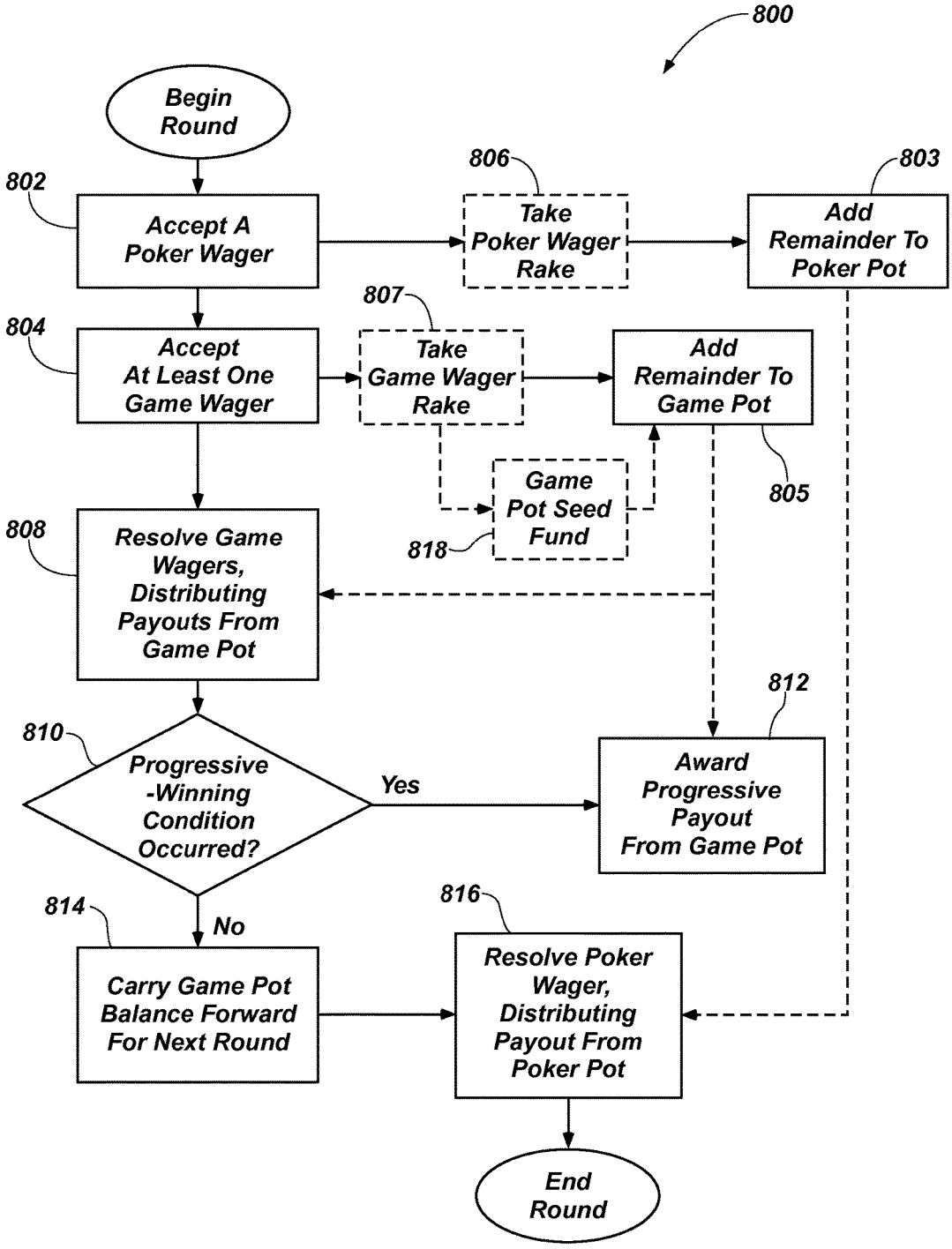
FIG. 12 is a flowchart diagram of a method of administering a wagering game, which may be at least partially player-pooled, according to a player-pooled progressive embodiment of this disclosure.

Referring to FIG. 12, shown is a flowchart diagram of a method 800 of administering a wagering game, which may be at least partially player-pooled, according to a player-pooled progressive embodiment. The method 800 includes accepting a first mandatory wager, referred to herein as a "poker wager," as indicated at 802. At least a portion of the poker wager is added to a poker pot, as indicated at operation 803. The poker wager may be later resolved by comparing player hands and awarding the poker pot, or at least a portion thereof, to the player holding a highest ranking poker hand in that round of play. For example, in a five card game, four of a kind would outrank three of a kind.

The poker pot may be a nonprogressive pot; more specifically, all or substantially all of the poker pot may be distributed at the conclusion of each round of the wagering game. In some embodiments, the poker wager may be a mandatory wager to qualify the player for play of the underlying wagering game. In other embodiments, the poker wager may be optional, and the wagering game may be administered to a player without receiving the poker wager and without qualifying the player for a potential payout from the poker pot.

At least one game wager may also be accepted, as indicated at 804. The game wagers may include, for example, base game wagers (e.g., ante wagers, blind wagers, play wagers, raises, and other wagers made on the underlying wagering game), side wagers, or both. More specifically, the game wagers may include, for example, one or more of the ante wager indicated at 102 (FIG. 1), the dealer bonus wager indicated at 104, and other side wagers as described above, e.g., a fortune bonus side wager, a progressive side wager, a bad beat side wager, and a dealer rank side wager. At least a portion of each game wager is added to a game pot, as indicated at operation 805, which game pot may be a progressive pot.

In some embodiments, acceptance of the at least one game wager qualifies a player to be eligible to win an award in addition to the payouts available from the underlying game (i.e., payouts on the ante, dealer bonus, fortune, progressive, bad beat, and dealer rank wagers), such as, for example, a progressive payout (e.g., a progressive jackpot awarded to one or more qualifying players). Therefore, in some such embodiments, a progressive wager may be received, in addition to the other game wagers received from the player, such as the ante, dealer bonus, fortune, progressive, bad beat, and dealer rank wagers. In other such embodiments, one of the game wagers may be converted to a progressive wager, such as, for example, the ante, dealer bonus, fortune, bad beat, and dealer rank wagers. In some embodiments, the progressive wager may be a mandatory wager to qualify the player for play of the underlying wagering game. In other embodiments, the progressive wager may be optional, and the wagering game may be administered to a player without receiving the progressive wager, in addition to any other game wagers, from the player and without qualifying the player to be eligible to win the progressive payout from the game pot.

In some embodiments, the poker wager and the at least one game wager may be received as indistinct wagers, with a portion thereof being designated for the poker pot (a nonprogressive pot) and another portion being designated for the game pot (a progressive pot).

In some embodiments, the game pot may be a pooled or linked pot. For example, the game pot may include one or more game wagers accepted from multiple concurrent wagering games. As another example, the game pot may include pooled progressive wagers from those wagering games currently being played and may include accumulated game wagers from past wagering games. As specific, non-limiting examples, the game pot may include all game wagers accepted from a group of electronic gaming tables or other local wagering game administration devices at a casino, from multiple groups of remote devices connected to network gaming architecture, or both. In other embodiments, the game pot may not be pooled, and awards for the game wager may be limited to the amounts wagered at a respective electronic gaming table, other local wagering game administration device, or group of remote devices.

The game administrator may take a "rake" on at least one wager, such as the poker wager, as indicated at operation 806, the at least one game wager, as indicated at operation 807, or both. In some embodiments, therefore, a rake may be taken on all wagers, or any wager. For example, the house may collect a portion of the poker wager at the time the poker wager is placed. Additionally or alternatively, the house may collect a portion of the game wagers at the time the game wagers are placed.

The rake may be, for example, a fixed percentage of the wagers. More specifically, the percentage of the wagers collected for the rake may be, for example, greater than a theoretical house advantage for the underlying game. As another example, the rake may be less than an average house advantage for play of the wagering game by all players, including average and sub-average players, which may be calculated using a historical house advantage for the wagering game (e.g., a house advantage for the wagering game over the last 5, 10, or 15 years for a given casino or other gaming establishment). As specific, non-limiting examples, the percentage of the wagers (i.e., either or both of the poker wager and the at least one game wager) collected for the rake may be between 3% and 8%, between 4% and 7%, or between 5% and 6%. In other embodiments, the portion of the wagers collected for the rake may be a variable percentage of the wagers or may be a fixed quantity (e.g., a flat fee) irrespective of the total amount for the wagers, a fixed percentage with a cap, or a time-based fee for increments of time playing the wagering game. Thus, in lieu of, or in addition to, a rake taken on one or more wagers, the house may be compensated in a number of other ways, including, without limitation, a flat fee per round of play, a percentage of wagers made with or without a cap, rental of a player "seat," or otherwise as is known in the gaming art.

All profits for the house may be made from the rake (or player entrance fee, for example) in some player-banked embodiments. In such embodiments, wagered amounts in excess of the rake are distributed either in the form of, for example, a progressive payout (as in a "player-pooled progressive" embodiment (FIG. 12)), a dividend refund (as in a "dividend refund" embodiment (FIG. 13)), or some combination thereof. Thus, the profits for the house may be limited. Such limiting of profits for the house and redistribution of wagers back to one or more players may increase the attractiveness of the wagering game to both inexperienced and highly skilled players. Because the amount earned by the house is known, highly skilled players may perceive that their skill will enable them to increase winnings, and inexperienced players may be enticed by the possibility of winning or otherwise earning a portion or all of one or more of the pots. In other embodiments, the house may make profits on the rake and on losses from one or more of the wagers (e.g., the ante, dealer bonus, fortune, progressive, bad beat, and dealer rank wagers), including losses resulting from optimal and suboptimal play.

The rake may be maintained in a rake account, and profits for the house may be deducted from the rake account. When and if taken from the poker wagers, the poker wager rake (operation 806) may be taken by, for example, electronically transferring funds from the poker wagers to a poker pot rake account (e.g., as instructed by a game service 616 (see FIG. 8) using casino account servers 632 (see FIG. 8)). Likewise, when and if taken from the game wagers, the game wager rake (operation 807) may be taken by, e.g., electronically transferring funds from the game pot wagers to a game pot rake account (e.g., as instructed by the game service 616 (see FIG. 8) using casino account servers 632 (see FIG. 8)).

In some embodiments, the poker wager may be accepted (operation 802) at the beginning of a round of administration of the wagering game. One or more of the game wagers may be accepted (operation 804) at the beginning of the round as well, e.g., the ante wager, the dealer bonus wager, the fortune wager, the progressive wager, the bad beat wager, or the dealer rank wager. In some embodiments, additional game wagers may be accepted (operation 804), possibly raked (operation 807), and added to the game pot (operation 805) in the intermediate segments of the round of play, e.g., the progressive wager or other side wagers.

The underlying wagering game may be played as described above, including resolving the game wagers received during the round of play, as indicated at operation 808. For example, the underlying wagering game may be played at least substantially as described previously in connection with FIGS. 1 through 3. Payouts to be distributed, as a result of resolving the game wagers, (e.g., ante wager, dealer bonus wagers, fortune wagers, bad beat wagers, and dealer rank wagers), are paid from the game pot.

It is contemplated that only a portion of the game pot may be distributed, at operation 806, in the form of payouts on the underlying game. At least in embodiments in which the game pot is configured as a progressive pot (e.g., if one of the game wagers is a progressive wager or one game outcome of a low frequency pays the amount of the pot), all or substantially all of the remaining portion of the game pot may be designated for a potential progressive payout. For example, administering the player-pooled progressive embodiment of the player-pooled wagering game may include determining whether a progressive-winning condition has occurred, as indicated at operation 810. A progressive-winning condition may be predefined as a predetermined winning hand combination being dealt, which may result in an award of, for example, a portion of the game pot, or a premium winning hand composition being dealt, which may result in an award of, for example, an entire amount of the game pot. If such a progressive-winning condition has occurred during the round of game administration, a progressive payout may be awarded to the winning-hand-holding player, with the progressive payout being paid from the game pot, as indicated at operation 812. As just one example, a game may pay a progressive payout for a seven-card straight flush. If no progressive-winning condition has occurred, a progressive payout may not be paid from the game pot, but, rather, the game pot balance may be carried forward for the next round of play and so on, as indicated at operation 814, until a progressive-winning condition occurs during a subsequent round. Thus, the game pot may not be awarded at the end of each round of play, but may grow during each successive round in which no player is dealt a predetermined winning hand combination or a premium winning hand composition. However, if the underlying game payouts distributed at operation 808, or if a progressive payout is awarded at operation 812, without draining the game pot, the game pot may decrement until the game pot contributions, at operation 805, rebuild the game pot.

A predetermined winning hand combination may be, for example, a four-of-a-kind, a full house, a flush, a straight, a three-of-a-kind, two pair, or one pair. The hands qualifying as new winning hand combinations may be predetermined at the beginning of each round of play in some embodiments. In other embodiments, new winning hand combinations may be predetermined at the beginning of play and may remain fixed until it is determined that at least one player hand achieves a predetermined winning hand combination, at which time new winning hand combinations may be predetermined. In still other embodiments, the hand combinations qualifying as winning hand combinations may be predetermined at the outset of the wagering game and remain fixed for the duration of the wagering game. The hands qualifying as winning hand combinations may be predetermined at random from a list of possible winning hand combinations, from among a schedule with a fixed rotation of possible winning hand combinations, or using a fixed table of winning hand combinations.

A premium winning hand composition may be, for example, a four-of-a-kind, a straight flush, or a royal flush. The hand compositions qualifying as premium winning hand compositions may remain fixed throughout the duration of the wagering game or may change during the wagering game. For example, after it has been determined that a player hand has achieved a premium winning hand composition, the hand compositions qualifying as premium winning hand compositions may be made more restrictive or less restrictive. As a specific, non-limiting example, after identification of a player hand achieving a straight flush, the hand compositions qualifying as premium winning hand compositions may be restricted to royal flushes or may be expanded to include four-of-a-kinds. The hands qualifying as premium winning hand compositions may be predetermined at random from a list of possible premium winning hand compositions, following a schedule with a fixed rotation of possible premium winning hand compositions, or according to a fixed table of premium winning hand compositions.

In embodiments in which the game pot is a progressive pot, the amount awarded from the game pot for achieving a premium winning hand composition may be a progressive payout at least as great as a maximum progressive payout for achieving a predetermined winning hand composition. For example, the entire game pot may be awarded when a player or multiple players are dealt a premium winning hand composition, and only a portion of the game pot may be awarded when a player or multiple players are dealt a predetermined winning hand combination.

Awarding the game pot or a portion of the game pot may involve crediting a player account with funds from the game pot or may comprise distributing physical money or physical representations of money from the game pot to the player.

Before, between, or after resolving the game wagers (operation 808), determining whether a progressive-winning condition occurred (operation 810), awarding a progressive payout (operation 812), or any combination thereof, the poker wager may be resolved, and the poker pot may be awarded to at least one player, as indicated at operation 816. Each successive round of receiving wagers, dealing cards, and resolving wagers may constitute a round of play, and the poker pot may be awarded to at least one player before the end of each round of play. The player to whom the poker pot is awarded may hold a highest ranking hand of all hands dealt in a round on a table using conventional poker rankings, or a ranking system specific to the disclosed games when compared to the hands of other players at the virtual "table."

Awarding the poker pot or the portion of the poker pot may involve crediting a player account of each winning player or may comprise distributing physical money or physical representations of money to each winning player.

In some embodiments, an entire amount of the poker pot may be awarded to at least one player before the end of each round of play. In such embodiments, the poker pot may be a nonprogressive pot. Awarding the entire amount of a poker pot to at least one player at the end of each round of play redistributes lost poker wagers attributable to suboptimal play to other players, rather than to the house.

In some embodiments involving a no-house-advantage poker pot awarded at the end of each round and a progressive game pot that receives all other game wagers, all players participating in the wagering game from whom the at least one game wager has been received may be eligible to win the game pot or a portion of the game pot. Players who are ineligible to win the poker pot, and players from whom fold indications have been received but from whom one or more other active wagers in play have been received, may be eligible to win the game pot or a portion of the game pot.

In some embodiments, the game pot may be seeded with money from the game pot rake account or a reserve account (as indicated at operation 818) at the beginning of play, after the game pot or a portion of the game pot has been awarded, or both. In some embodiments, a minimum account balance sufficient to cover expected losses is retained when distributing a progressive payout (operation 812) such that no seed money is required in the game pot. For example, the game pot may be seeded from the rake account of the house (operation 818), and the house may maintain an amount of funds in the rake account sufficient to significantly reduce (e.g., to essentially eliminate) the likelihood that any payouts made from the rake account and any seeding amounts withdrawn from the rake account exhaust or overdraw the rake account. In some embodiments, a casino reserve account may be provided to fill the rake account in the event of an overdraw. Such seeding may incentivize players to participate in the wagering game, and specifically to place a game wager (e.g., a progressive wager) to be eligible for the progressive payout from the game pot. In addition, such seeding may reduce the likelihood that the amount of funds in the game pot may be insufficient to cover all the payouts to players. For example, where a player hand achieves a premium winning hand composition in one round of play, a player hand achieves a predetermined winning hand combination in the immediately following round of play, and a fixed-odds payout is to be awarded to the player holding the predetermined winning hand combination, the amount seeded to the game pot between those rounds of play may be at least as great as the maximum fixed-odds payout awardable for any predetermined winning hand combination. The game pot may be seeded each time the game pot is awarded in its entirety or each time the amount in the game pot is lower than the maximum fixed-odds payout.

Figure 13:
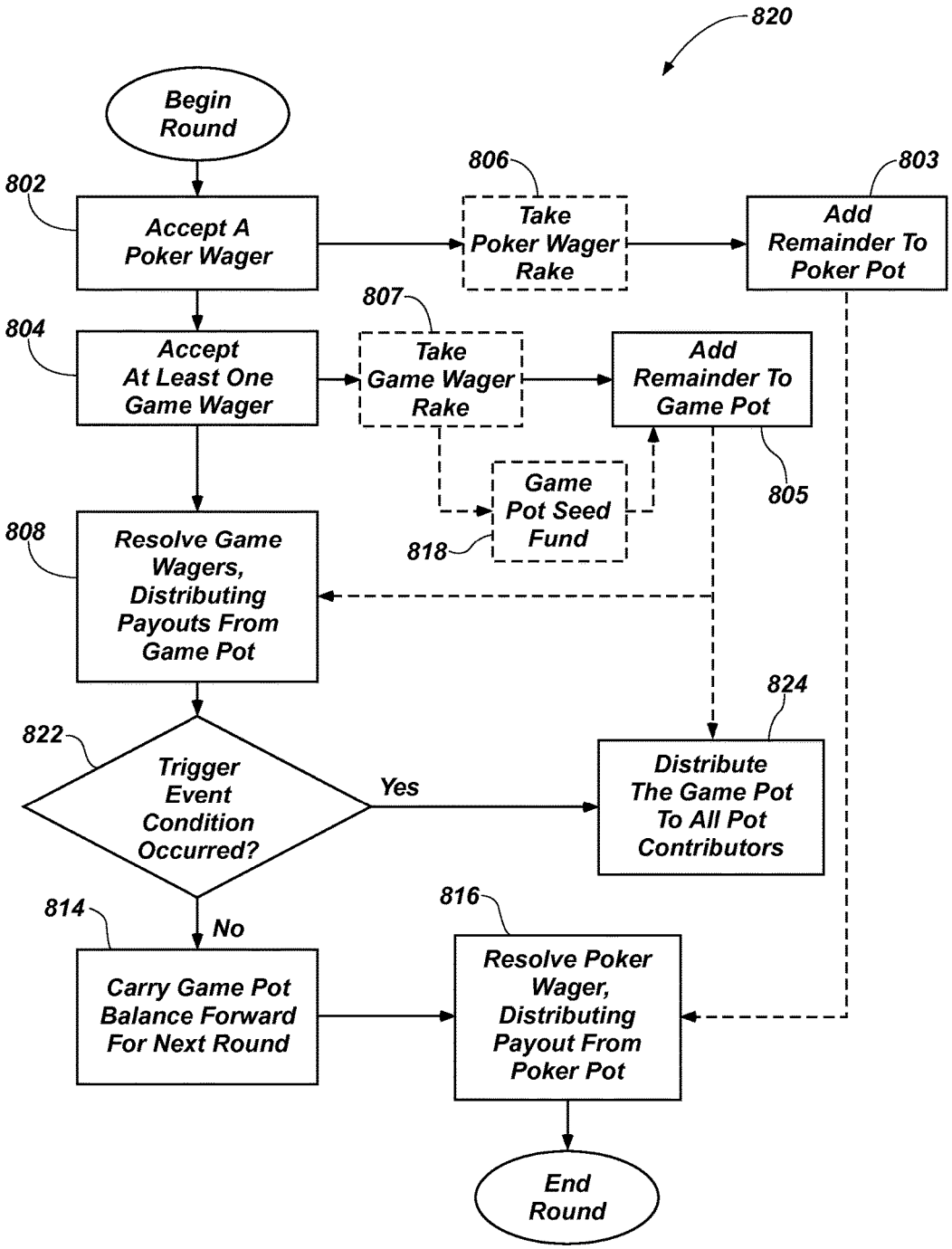
FIG. 13 is a flowchart diagram of a method of administering a wagering game, which may also be at least partially player-pooled, according to a dividend refund embodiment of this disclosure.

FIG. 13 is a flowchart diagram of a method 820 of administering a wagering game, which may be at least partially player-pooled, according to a dividend refund embodiment. The method 820 is largely the same as the method 800 of the player-pooled progressive (FIG. 12), with the exception that, rather than determining whether a progressive-winning condition has occurred (operation 810 (FIG. 12)), the method 820 includes determining whether a trigger event condition has occurred, as indicated at operation 822, and, if so, distributing the game pot to one or more past or present players of the wagering game, as indicated at operation 824 (rather than distributing the game pot as a progressive payout as at operation 812 (FIG. 12)). In such an embodiment, the game pot may accumulate between rounds of play, and, to periodically reduce the balance, a dividend (e.g., a share of the game pot awarded to each participating player) may be awarded to players from the game pot. Thus, what would otherwise be the profits from lost wagers, less amounts raked by the house, are redistributed back to the players, rather than collected by the house as revenue. Thus, the distribution is not a payout on the underlying game, but a refund.

The game pot may be distributed among a plurality of players upon the occurrence of a predetermined event (referred to herein as a "trigger event"), as indicated at operation 822. The predetermined, trigger event may not be based, for example, on player skill or chance events occurring in the underlying wagering game. The predetermined trigger event may comprise, for example, determination that at least one player participated for a predetermined number of hands; completed a predetermined number of rounds of play at a given table, electronic gaming machine, or remote gaming device; reached a predetermined time limit since play commenced; or reached a predetermined amount within the game pot. The predetermined trigger event or condition may be time-based, pot-based (or pool-based), game-based, amount-based, or other-based. Further details on pot distributions based on predetermined trigger events and conditions are disclosed in the U.S. patent application Ser. No. 13/871,824, filed Apr. 26, 2013, titled "DISTRIBUTING SUPPLEMENTAL POT IN WAGERING GAMES BASED ON PREDETERMINED EVENT," the disclosure of which is incorporated herein in its entirety by this reference.

The dividend distributions may be divided at least among players currently participating in the wagering game. In some embodiments, the dividend distributions may also be paid to players who previously contributed to the game pot but who have since ceased participating in the wagering game. In some embodiments, the dividend distributions may not be paid to players from whom contributions to the game pot have not been received since the last dividend distribution was paid. The percentage of the game pot refunded to each player as a dividend distribution may be, for example, approximately equal to the percentage of hands won by each player, the percentage of first pot winnings won by each player based on game play, the percentage of total wager amounts received from each player, the proportional number of wagers received from each player, the proportional length of time spent playing the wagering game by each player, or an equal percentage for each player eligible to receive a dividend distribution from the game pot.

The dividend refund may be distributed in the form of a credit made to the receiving players' accounts. In some embodiments, the refund may be paid without concurrently alerting the player, though the refund may be noticeable when and if the player next checks his or her balance in his or her player account.

In some embodiments, wagering games may be administered without players risking money in connection with the wagers (i.e., "play-for-fun" games). Access to play-for-fun wagering games may be granted on a time period basis in some embodiments. For example, upon initially joining the wagering game, each player may automatically be given nonmonetary wagering elements, such as, for example, chips, points, or simulated currency, that are of no redeemable value. After joining, the player may be permitted to place bets using the wagering elements and a timer may track how long the player has been participating in the wagering game. If the player exhausts his or her supply of the wagering elements before a predetermined period of time has expired, the player may be permitted to simply wait until the period of time passes to rejoin the game, at which time access to another quantity of the wagering elements may be granted to the player to permit the player to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, who have wagered the most in a play-for-pay environment, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait for an award of more wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may be allowed to retain their remaining wagering elements for subsequent allotments of time, and may be given additional wagering elements corresponding to the new allotment of time to further increase the balance of wagering elements at their disposal. Players may be assigned to different categories of players, which determine the number of wagering elements awarded. In a given period of time, higher level players, or players who have invested more time playing the game may be allotted more wagering elements per unit of time than a player assigned to a lower level group.

Therefore, in some embodiments, the wagering game may be administered by receiving wagers (e.g., ante wagers, dealer bonus wagers, fortune wagers, progressive wagers, bad beat wagers, and dealer rank wagers) of no real-world monetary value, and payouts (e.g., ante wager payouts, dealer bonus wager payouts, fortune wager payouts, progressive wager payouts, bad beat wager payouts, dealer rank payouts, envy payouts) may be paid without transferring real-world monetary value to the players. Such embodiments, referred to herein as "free play-for-fun" embodiments are nonetheless contemplated as modes of carrying out the methods described herein.

In some embodiments, referred to herein as "social play-for-fun" embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be sold or may be given without directly exchanging money for the access tokens. For example, access tokens may be allocated to players who participate in member events (e.g., complete surveys, receive training on how to play the wagering game, share information about the wagering game with others), spend time participating in the wagering game or in a player account forum (e.g., logged in to a social media account), or view advertising. Thus, an entity administering social play-for-fun wagering games may not receive money from losing player wagers or may not take a rake on wagers, but may receive compensation through advertising revenue or through the purchase of access tokens redeemable for time compressions to continue play of the wagering game or simply to increase the quantity of wagering elements available to a player.

After receipt of an indication that a player has stopped participating in a play-for-fun wagering game (e.g., a free play-for-fun embodiment, a social play-for-fun embodiment), any remaining quantities of the wagering elements may be relinquished by the player and retained by the administrator, in some embodiments. For example, receipt of an indication that the player has logged out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, upon receipt of an indication that a player has stopped playing, the quantity of wagering elements held by the player at that time may be retained and made available to the player, along with any additional quantities of wagering elements granted for new allotments of time, upon receipt of an indication that the player has rejoined the wagering game.

What is claimed is:

1. A method of administering a wagering game, comprising:

accepting an ante wager to participate in a commission-free pai gow poker game from at least one player by receiving a first physical, monetarily valuable wagering element in a first designated area of a layout on a surface of a gaming table, the first designated area being defined by a shape printed on the surface of the gaming table;

accepting a side bet wager from the at least one player by receiving a second physical, monetarily valuable wagering element in a second designated area of the layout on the surface of the gaming table, the second designated area being defined by another shape printed on the surface of the gaming table and being separate and distinct from the first designated area;

receiving at least one packet of seven randomized physical cards from an automatic card shuffler;

dealing the at least one packet of seven randomized physical cards from a set of cards comprising at least one 52-card deck of standard playing cards to provide a seven-card hand to the at least one player and a seven-card hand to a dealer;

resolving the ante wager by comparing two-card and five-card pai gow player hands formed from the at least one player's seven-card hand and respectively placed in designated low hand and high hand areas printed on the surface of the gaming table, with two-card and five-card pai gow dealer hands formed from the dealer's seven-card hand, wherein no commission is received on any player winnings on the ante wager; and independent of an outcome of the resolution of the ante wager, paying a side bet payout to the at least one player based on the side bet wager when the dealer's seven-card hand contains a winning hand of a set of predetermined winning hands, wherein the set of predetermined winning hands includes at least one winning hand formed of seven cards, by transferring physical, monetarily valuable wagering elements associated with the side bet payout to the at least one player, wherein paying the side bet payout to the at least one player comprises paying only a single highest achieved side bet payout to each player associated with a side bet for a single predetermined winning hand within the dealer's seven-card hand.

2. The method of claim 1, wherein paying the side bet payout to the at least one player when the dealer's seven-card hand contains a winning hand of the set of predetermined winning hands comprises paying the side bet payout to the at least one player when the dealer's seven-card hand comprises at least one winning poker hand.

3. The method of claim 1, wherein paying the side bet payout to the at least one player when the dealer's seven-card hand contains a winning hand of the set of predetermined winning hands comprises paying the side bet payout to the at least one player when the dealer's seven-card hand comprises at least a two-card winning poker hand.

4. The method of claim 1, wherein paying the side bet payout to the at least one player when the dealer's seven-card hand contains a winning hand of the set of predetermined winning hands comprises paying the side bet payout to the at least one player when the dealer's seven-card hand comprises at least a five-card winning poker hand.

5. The method of claim 1, wherein paying the side bet payout to the at least one player when the dealer's seven-card hand contains a winning hand of the set of predetermined winning hands comprises paying the side bet payout to the at least one player when the dealer's seven-card hand comprises a combination of a two-card winning poker hand and a five-card winning poker hand.

6. The method of claim 5, wherein the two-card winning poker hand comprises a king and a queen having the same suit and the five-card winning poker hand comprises an ace, king, queen, jack, and ten having the same suit.

7. The method of claim 1, wherein paying the side bet payout to the at least one player when the dealer's seven-card hand contains a winning hand of the set of predetermined winning hands comprises paying the side bet payout to the at least one player when the dealer's seven-card hand comprises a seven-card winning poker hand.

8. The method of claim 1, wherein paying the side bet payout to the at least one player when the dealer's seven-card hand contains a winning hand of the set of predetermined winning hands comprises paying the side bet payout to the at least one player when the dealer's seven-card hand comprises a seven-card straight flush.

9. The method of claim 1, wherein a winning hand of the set of predetermined winning hands comprises a nine-high two-card hand.

10. The method of claim 1, wherein paying the side bet payout to the at least one player based on the side bet wager comprises paying a fixed-odds side bet payout of from 2 to 1 to 500 to 1.

11. The method of claim 1, wherein paying the side bet payout to the at least one player based on the side bet wager when the dealer's seven-card hand contains a winning hand of the set of predetermined winning hands comprises paying the side bet payout to the at least one player according to the following pay table:

| Dealer Hand | Payout |
|---|---|
| Seven Card Straight Flush | 500 to 1 |
| Royal Flush + Royal Match | 500 to 1 |
| Five Aces | 500 to 1 |
| Royal Flush | 150 to 1 |
| Straight Flush | 50 to 1 |
| Four of a Kind | 25 to 1 |
| Full House | 4 to 1 |
| Flush | 3 to 1 |
| Three of a Kind | 2 to 1 |
| Straight | 2 to 1 |
| Nine-High Low Hand | 5 to 1. |

12. The method of claim 1, wherein resolving the ante wager further comprises declaring a push for the at least one player if the dealer plays a pai gow hand of a predetermined disqualifying rank.

13. The method of claim 1, wherein resolving the ante wager further comprises paying a fixed-odds payout on the ante wager if the dealer plays a pai gow hand of a predetermined disqualifying rank.

14. The method of claim 13, wherein paying a fixed-odds payout on the ante wager if the dealer plays a pai gow hand of a predetermined disqualifying rank comprises paying a fixed-odds payout of from 1 to 1.5 to 1 to 4.

15. The method of claim 1, wherein paying a side bet payout to the at least one player based on the side bet wager comprises paying the side bet payout to the at least one player based on the side bet wager before resolving the ante wager.

16. The method of claim 1, wherein paying a side bet payout to the at least one player based on the side bet wager comprises paying the side bet payout to the at least one player based on the side bet wager after resolving the ante wager.

17. A method of administering a wagering game, comprising:

accepting an ante wager from at least one player on a game of pai gow poker to be played against a dealer by receiving a first physical, monetarily valuable wagering element in a first designated area on a surface of a gaming table;

accepting a side bet wager from the at least one player by receiving a second physical, monetarily valuable wagering element in a second designated area on the surface of the gaming table, the second designated area being separate and distinct from the first designated area;

receiving at least one packet of seven randomized physical cards from an automatic card shuffler;

dealing the at least one packet of seven randomized physical cards from a set of cards comprising at least one 52-card deck of standard playing cards to provide a seven-card hand to the at least one player and a seven-card hand to a dealer;

resolving the ante wager, wherein resolving the ante wager comprises taking no commission on any winnings provided to the at least one player and returning each ante wager to each player when a low hand held by the dealer is of a predetermined disqualifying rank; and independent of an outcome of the resolution of the ante wager, paying a side bet payout to the at least one player based on the side bet wager when the dealer's seven-card hand contains one winning hand of a set of predetermined winning hands, wherein the set of predetermined winning hands includes at least one winning hand formed of seven cards, by transferring physical, monetarily valuable wagering elements associated with the side bet payout to the at least one player, wherein the side bet payout is paid to each player associated with a side bet for only a single highest achieved side bet payout for a single predetermined winning hand within the dealer's seven-card hand.

18. The method of claim 17, wherein returning each ante wager to each player when the low hand held by the dealer is of a predetermined disqualifying rank comprises returning each ante wager to each player when the low hand held by the dealer is a nine-high.

* * * * *